US010226767B2

(12) United States Patent
Pereira et al.

(10) Patent No.: US 10,226,767 B2
(45) Date of Patent: Mar. 12, 2019

(54) FLUIDIC CELL DESIGNS FOR INTERFACING MICROFLUIDIC CHIPS AND NANOFLUIDIC CHIPS

(71) Applicant: INTERNATIONAL BUSINESS MACHINES CORPORATION, Armonk, NY (US)

(72) Inventors: Michael A. Pereira, Mohegan Lake, NY (US); Joshua T. Smith, Croton on Hudson, NY (US); Benjamin H. Wunsch, Mt. Kisco, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 15/886,892

(22) Filed: Feb. 2, 2018

(65) Prior Publication Data

US 2018/0154360 A1 Jun. 7, 2018

Related U.S. Application Data

(60) Division of application No. 14/952,148, filed on Nov. 25, 2015, which is a continuation of application No. 14/927,936, filed on Oct. 30, 2015.

(51) Int. Cl.
*B01L 3/00* (2006.01)

(52) U.S. Cl.
CPC ... *B01L 3/502707* (2013.01); *B01L 3/502715* (2013.01); *B01L 3/502723* (2013.01);
(Continued)

(58) Field of Classification Search
CPC ..... B01L 2200/025; B01L 2200/027; B01L 2200/0684; B01L 2200/12;
(Continued)

(56) References Cited

U.S. PATENT DOCUMENTS 8,343,425 B1 * 1/2013 Li ..... B01F 13/0061 422/502
2003/0136679 A1 * 7/2003 Bohn ..... B01D 57/02 204/543

(Continued)

OTHER PUBLICATIONS

Peng et al. Jounral of Vaccine Science Technology B, vol. 24(4), Jul./Aug. 2006, pp. 1941-1946.*

(Continued)

*Primary Examiner* — Maureen Wallenhorst
(74) *Attorney, Agent, or Firm* — Cantor Colburn LLP; Vazken Alexanian

(57) ABSTRACT

A technique relates to a fluidic cell configured to hold a nanofluidic chip. A first plate is configured to hold the nanofluidic chip. A second plate is configured to fit on top of the first plate, such that the nanofluidic chip is held in place. The second plate has at least one first port and at least one second port. The second plate has an entrance hole configured to communicate with an inlet hole of the nanofluidic chip. The second port is angled above the first port, such that the first port and second port intersect to form a junction. The second port is formed to have a line-of-sight to the entrance hole, such that the second port is configured to receive input for extracting air trapped at a vicinity of the entrance hole.

19 Claims, 19 Drawing Sheets

(52) U.S. Cl.
CPC ... *B01L 3/502776* (2013.01); *B01L 2200/025* (2013.01); *B01L 2200/027* (2013.01); *B01L 2200/0684* (2013.01); *B01L 2200/12* (2013.01); *B01L 2300/0609* (2013.01); *B01L 2300/0816* (2013.01); *B01L 2300/0864* (2013.01); *B01L 2300/0896* (2013.01); *B01L 2300/12* (2013.01); *B01L 2400/0406* (2013.01); *B01L 2400/0487* (2013.01); *B01L 2400/06* (2013.01); *B01L 2400/0622* (2013.01); *Y10T 436/2575* (2015.01)

(58) Field of Classification Search
CPC ..... B01L 2300/0896; B01L 2300/12; B01L 2300/0609; B01L 2300/0816; B01L 2300/0864; B01L 2400/06; B01L 2400/0406; B01L 2400/0487; B01L 2400/0622; B01L 3/502707; B01L 3/502715; B01L 3/502723; B01L 3/502776; Y10T 436/25; Y10T 436/2575
USPC ..... 436/174, 180; 422/502, 503, 504, 507
See application file for complete search history.

(56) References Cited

U.S. PATENT DOCUMENTS

| | | | | |
|---|---|---|---|---|
| 2007/0217957 | A1* | 9/2007 | Flachsbart | B01L 3/502707 137/803 |
| 2009/0238722 | A1* | 9/2009 | Mora-Fillat | B01L 3/502753 422/68.1 |
| 2011/0027873 | A1* | 2/2011 | Cho | B81B 3/0094 435/287.1 |
| 2017/0120245 | A1 | 5/2017 | Pereira et al. | |
| 2017/0120247 | A1 | 5/2017 | Pereira et al. | |

OTHER PUBLICATIONS

List of IBM Patents or Patent Applications Treated as Related; (Appendix P), Filed Feb. 2, 2018; pp. 1-2.

* cited by examiner

FLUIDIC CELL DESIGNS FOR INTERFACING MICROFLUIDIC CHIPS AND NANOFLUIDIC CHIPS

DOMESTIC PRIORITY

This application is a divisional of U.S. patent application Ser. No. 14/952,148, filed Nov. 25, 2015, which is a continuation of U.S. patent application Ser. No. 14/927,936, filed Oct. 30, 2015, the disclosures of which are incorporated by reference herein in their entirety.

BACKGROUND

The present invention relates to microfluidic chips and/or nanofluidic chips, and more specifically, to fluidic cell designs (e.g., housings) that interface with microfluidic chips and/or nanofluidic chips.

Nanofluidics is the study of the behavior, manipulation, and control of fluids that are confined to structures of nanometer (typically 1-100 nanometers (nm)) characteristic dimensions. Fluids confined in these nanometer structures exhibit physical behaviors not observed in larger structures, such as those of micrometer dimensions and above, because the characteristic physical scaling lengths of the fluid (e.g., Debye length, hydrodynamic radius) very closely coincide with the dimensions of the nanostructure itself. In nanofluidics, fluids are moved, mixed, separated, or otherwise processed. Numerous applications employ passive fluid control techniques like capillary forces. In some applications external actuation means are additionally used for a directed transport of the fluids.

SUMMARY

According to one embodiment, a fluidic cell configured to hold a nanofluidic chip is provided. The fluidic cell includes a first plate configured to hold the nanofluidic chip, and a second plate configured to fit on top of the first plate, such that the nanofluidic chip is held in place. The second plate has at least one first port and at least one second port, and the second plate has an entrance hole configured to communicate with an inlet hole of the nanofluidic chip. The at least one second port is angled above the at least one first port, such that the at least one first port and the at least one second port intersect to form a junction. The at least one second port is formed to have a line-of-sight to the entrance hole, such that the at least one second port is configured to receive input for extracting air trapped at a vicinity of the entrance hole.

According to one embodiment, a method of configuring a fluidic cell to enable air removal is provided. The method includes positioning a first plate configured to hold a nanofluidic chip, positioning a second plate configured to fit on top of the first plate, such that the nanofluidic chip is held in place. The second plate has at least one first port and at least one second port. The second plate has an entrance hole configured to communicate with an inlet hole of the nanofluidic chip, where the at least one second port is angled above the at least one first port, such that the at least one first port and the at least one second port intersect to form a junction. Also, the method includes arranging the at least one second port to have a line-of-sight to the entrance hole, such that the at least one second port is configured to receive input for extracting air trapped at a vicinity of the entrance hole.

According to one embodiment, a fluidic cell configured to hold a nanofluidic chip is provided. The fluidic cell includes a mounting base plate configured to hold the nanofluidic chip, and multiple connector plates positioned on top of the mounting base plate. The multiple connector plates include a first connector plate positioned on top of the mounting base plate to communicate fluidly with the nanofluidic chip, a next connector plate positioned on top of the first connector plate, through a last connector plate positioned on top of the next connector plate. The next connector plate is configured to communicate fluidly with the nanofluidic chip through the first connector plate. The last connector plate is configured to communicate fluidly with the nanofluidic chip through the next connector plate and the first connector plate.

According to one embodiment, a method of configuring a fluidic cell with multiple stages is provided. The method includes positioning a mounting base plate configured to hold a nanofluidic chip, and positioning multiple connector plates on top of the mounting base plate. The multiple connector plates including a first connector plate positioned on top of the mounting base plate to communicate fluidly with the nanofluidic chip, a next connector plate positioned on top of the first connector plate, through a last connector plate positioned on top of the next connector plate. The next connector plate is configured to communicate fluidly with the nanofluidic chip through the first connector plate. The last connector plate is configured to communicate fluidly with the nanofluidic chip through the next connector plate and the first connector plate.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE DRAWINGS

FIGS. 15A and 15B are a schematic of an overhead view of a three-tier stack of connector plates according to an embodiment.

DETAILED DESCRIPTION

Nanofluidics is a field of nanotechnology and engineering that manipulates fluids using devices where the critical structure dimensions are the order of nanometers. Their importance stems from the ability to manipulate samples in minute quantities, allowing the miniaturization of analytical and preparative methods that are normally carried out on the milliliter or greater scale. Many important biological, chemical, and material entities, such as proteins, organelles, plastids, supramolecular complexes, and colloids, function in fluids, and their manipulation and analysis can be facilitated with nanofluidic devices which can handle small sample sizes.

The application of silicon (Si) nanofabrication to the field of biotechnology is opening opportunities in producing nanoscale fluidic devices. With the ability to produce small element features, in high densities at manufacturable volumes, silicon based nanofluidics allows integration of biochemical and molecular biological techniques with on-chip sensors and logic. This miniaturization of biological techniques to lab-on-a-chip technology allows merging of sophisticated diagnostics with high mobility, for broad applications in medicine, agriculture, manufacturing, and environmental monitoring.

In all nanofluidic applications based on Si nanofabrication, a particular engineering aspect is the interfacing between the nanofluidic device on the chip and either (1) the external environment (macroscopic world) or (2) other on-chip components such as sensors, logic, reservoirs, etc. Fluidic samples are to be loaded into the chip, and auxiliary fluids, such as buffers, cleaning agents, reagents, etc., are metered out and injected into the fluid flow at desired intervals.

In addition, for practical applications, nanofluidic chips are to be insulated from the external environment to prevent damage and contamination, and this requires a module for both housing the chip and allowing the various inputs and outputs to be connected to the chip in a secure, functional, and reproducible manner. Embodiments are configured to address one or more of the issues.

Embodiments provide nanofluidic cells that (1) house nanofluidic chips, (2) allow external fluid inputs to be connected to the chip for interfacing and operation, (3) allow facile removal of excess air (e.g., air bubbles) or contamination from the fluid inputs, (4) allow multiple fluid inputs to be switched and directed to different nanofluidic devices, (5) provide a protective encasing for mobile nanofluidic applications, and/or (6) allow output fluids to be collected and removed from the nanofluidic chip(s).

Figure 1:
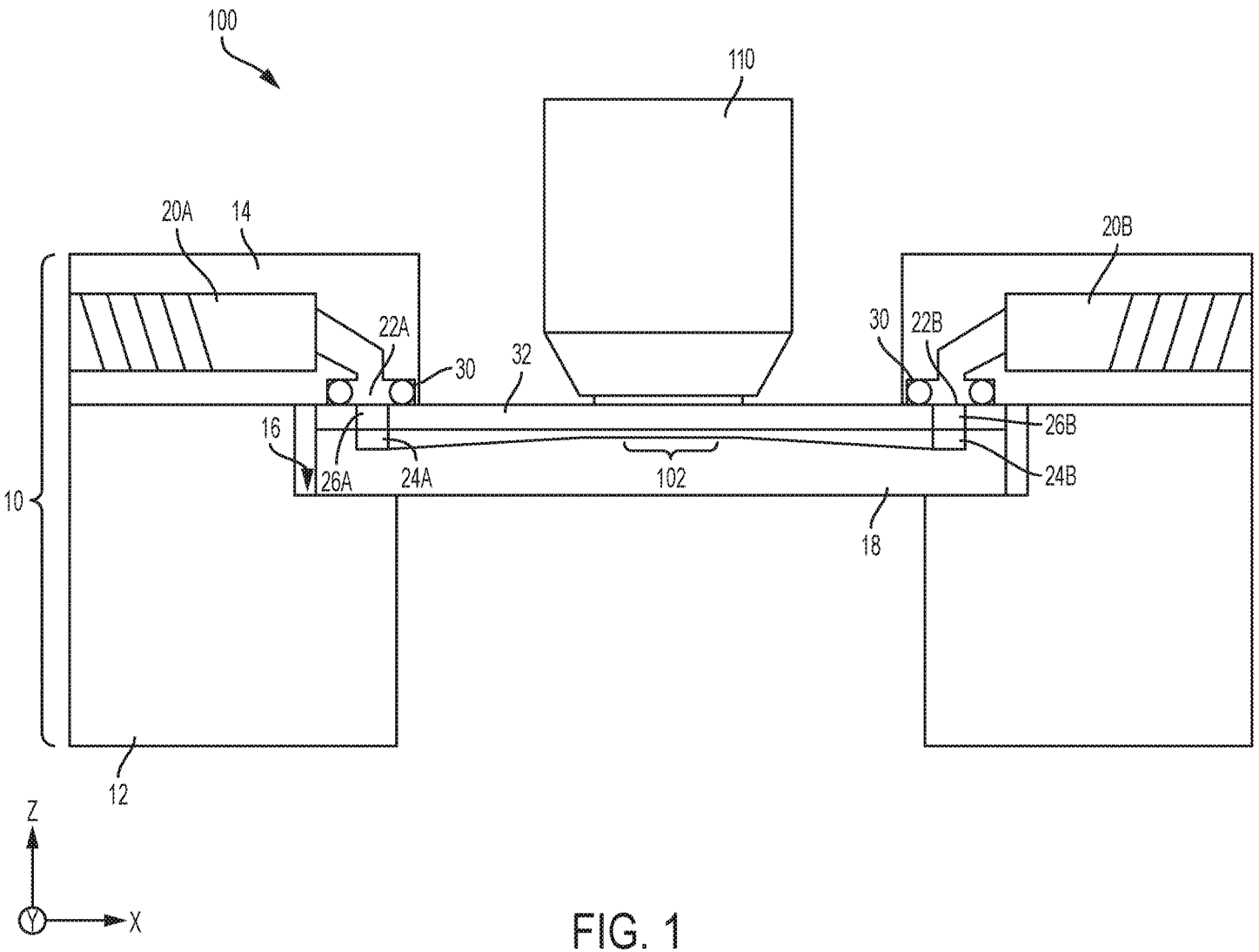
FIG. 1 is a schematic of a nanofluidic cell design/setup according to an embodiment.

FIG. 1 is a schematic of an exemplary nanofluidic cell design/setup 100 according to an embodiment. In the nanofluidic cell (cell) design 100, a nanofluidic cell 10 comprises two plates, a bottom mounting base 12 and a top connector plate 14. In one implementation, the connector plate 14 may have multiple stages or multiple plates as discussed further herein. A depression 16 in the mounting base 12 holds a nanofluidic chip 18, and nanofluidic chip 18 has one or more nanofluidic device 102 formed on the chip 18. Nanofluidic devices, which can separate, sort, and/or manipulate nanoparticles (including molecules in the nanometer size), are understood by one skilled in the art. The top connector plate 14 includes a series of openings or ports 20 (e.g., input ports 20A and output ports 20B), through which micro-connectors (e.g., high performance liquid chromatography (HPLC) fittings, micro tubing, syringes, pipets, capillaries, etc.) can be inserted to inject fluid into the chip 18 and remove fluid. For explanation purposes, micro-connector port 20A may be considered the input while micro-connector port 20B is considered the output, although these roles could be reversed.

Micro-connector ports 20A, 20B feed into holes 22A, 22B on the connector plate's bottom face, which interface directly with the nanofluidic chip 18 via coverslip holes 26A, 26B of a chip coverslip 32. For these purposes the coverslip 32 is structured with a pattern of holes 26A, 26B that match the top plate's hole (22A, 22B) configuration. The micro-connector ports 20A, 20B allow fluid to interface with the nanofluidic devices 102 on the nanofluidic chip 18. The chip coverslip 32 and the nanofluidic chip 18 may be considered as one piece (i.e., the nanofluidic chip), as the coverslip 32 may be a very thin film or glass attached to the nanofluidic chip 18 for protection and sealing.

For these nanofluidic devices 102, the nanofluidic chip 18 has open regions 24A that co-locate with the coverslip holes 26A and interface with the connector plate holes 22A, allowing fluid injection to occur from the connector plate 14 through the coverslip holes 26A and into the chip 18. This is termed front-side fluidic loading. O-rings 30, or other sealing options, provide a liquid-tight seal between the connector plate 14 and chip 18, providing a single flow path between the external input, i.e., the micro-connector ports 20A, 20B, and the chip 18. The O-rings 30 are mechanical gaskets, in the shape of a ring, designed to be provide a liquid-tight seal.

Figure 2:
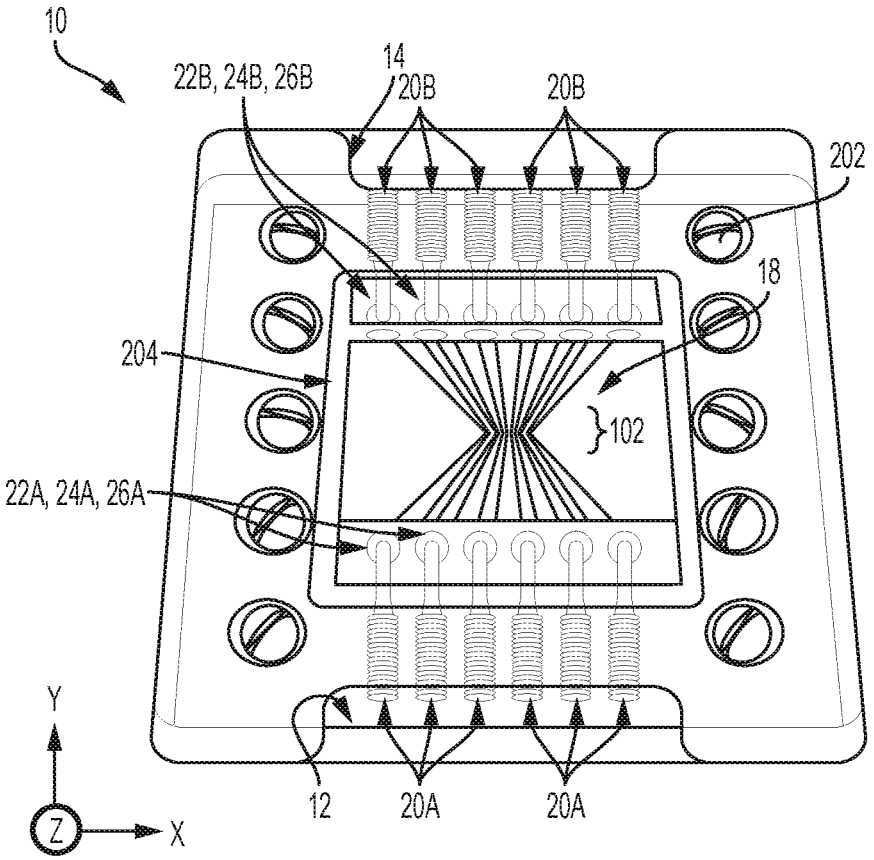
FIG. 2 is a schematic of a top-down view of the nanofluidic cell with a nanofluidic chip loaded according to an embodiment.

FIG. 2 is a schematic of a top-down view of the nanofluidic cell 10 with the nanofluidic chip 18 loaded according to an embodiment. A window 204 in the connector plate 14 allows imaging equipment 110 (shown in FIG. 1), e.g., microscopes or spectrometers, to be positioned over the chip 18 for in situ observation during operation. The dimensions of the window 204 may be customized to allow the imaging objective (e.g., lens, mirror, etc.) of the imaging equipment 110 to be at its correct working distance and allow the objective to be moved around the chip 18 for surveillance. The nanofluidic cell 10 may have fastening holes 202 that can be utilized to attach the connector plate 14 to the mounting plate 12. In one implementation, screws or other fasteners may be utilized to attach the connector plate 14 to the mounting plate 12.

The configuration of threaded ports 20A, 20B may be for a one-to-one input to output system. For example, for each nanofluidic device 102 (e.g., where there are a total of six nanofluidic devices 102 shown in FIG. 2), there is a single input port 20A and corresponding single output port 20B, which allow fluid to be input and output through the nanofluidic device 102. Particularly, this example shows six inlet ports 20A and six corresponding outlet ports 20B. Additionally, the modularity of the nanofluidic cell 10 allows different connector plates 14, with different numbers and configurations of input/outputs ports 20A, 20B and input/output holes 22A, 22B, to be readily switched out on the mounting base 12. In other words, a nanofluidic chip 18 may be loaded with fewer or more than six nanofluidic devices 102, and a corresponding different connector plate 14 can be attached to the mounting base 14, where the corresponding connector plate 14 has the exact same number of input ports 20A and output ports 20B (along with proper spacing) to match the number of nanofluidic devices 102 (e.g., 10). Accordingly, a plurality of connector plates 14 are available with the preconfigured holes 26A, 26B, ports 20A, 20B, and spacing to match the holes 24A, 24B, holes 26A, 26B, and spacing of the nanofluidic chip 18 (loaded with nanofluidic devices 102). All parts of the nanofluidic cell 10 may be fabricated from different materials, to accommodate different solvents/reagents, such as, e.g., acids, bases, oxidants, organics, etc.

Figure 3:
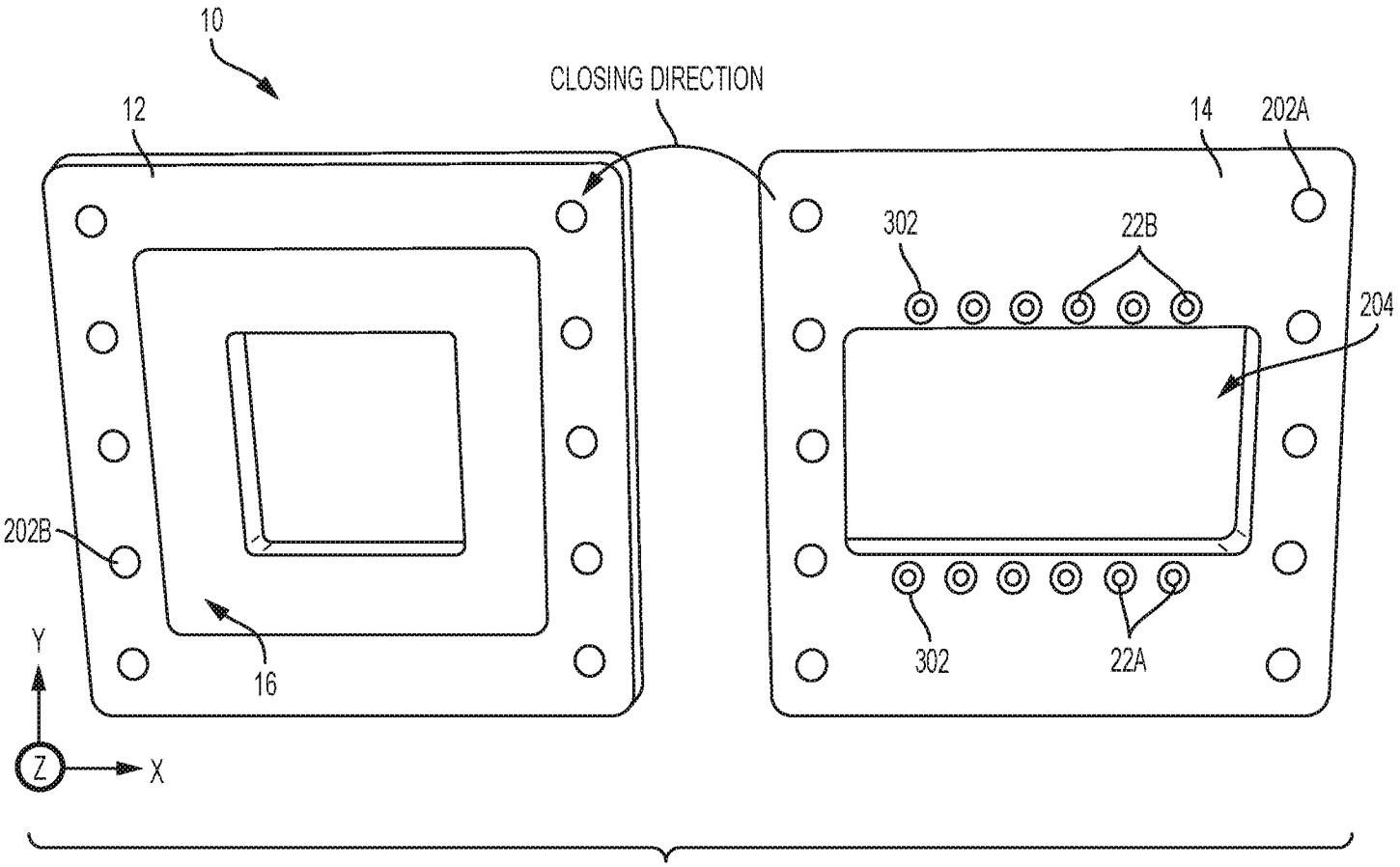
FIG. 3 is a schematic of the nanofluidic cell according to an embodiment.

FIG. 3 is a schematic of an open sandwich view of a nanofluidic cell 10 according to an embodiment. In FIG. 3, the nanofluidic cell 10 may be produced out of numerous materials including plastics, e.g. polyetheretherketone, acrylic, polytetrafluoroethylene, etc., metals, ceramics, or elastomers, e.g., crosslinked polysiloxanes. In FIG. 3, as an example, the cell 10 has been produced out of polyetheretherketone (PEEK), and the nanofluidic cell 10 formed out of PEEK may be used for organic solvent nanofluidic applications according to an embodiment. In FIG. 3, the face of the connector plate 14 is to be placed on top of the face of the mounting base 12, similar to closing a sandwich. In FIG. 3, the connector plate 14 may have fastener holes 202A that align with the fastener holes 202B in the mounting base 12. The connector plate 14 may have O-ring seats 302 on which the O-rings 30 sit, the O-ring seats 302 are around each of the holes 22A, 22B that connect to the nanofluidic chip 18. The mounting base 12 shows the depression 16 that holds the nanofluidic chip 18 (not shown in FIG. 3). In one implementation, the depression 16 may be several microns to millimeters deep, and a typical value of 670 μm corresponds to a typical silicon wafer chip plus glass coverslip.

Figure 4:
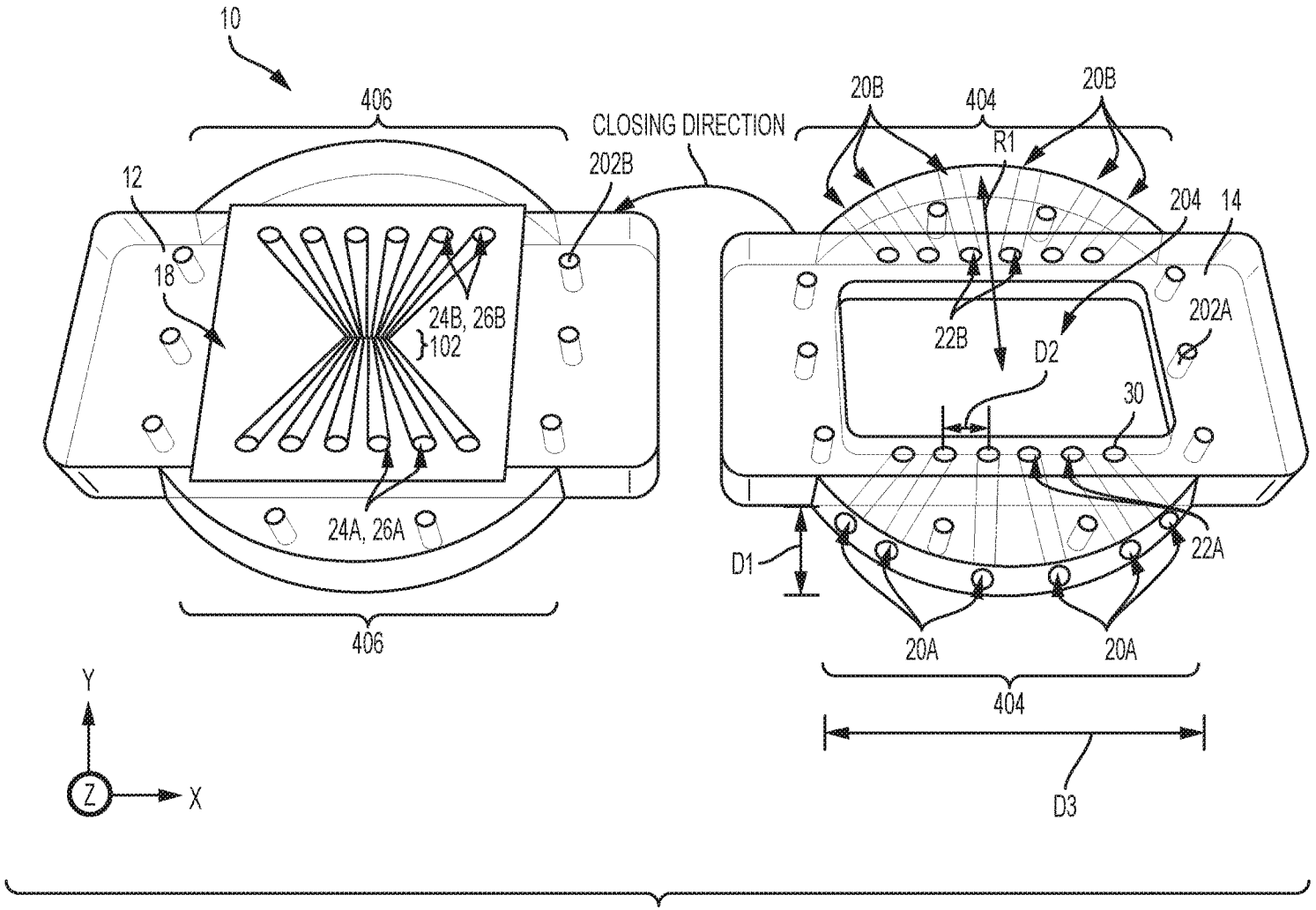
FIG. 4 is a schematic of the nanofluidic cell with a radial design according to an embodiment.

As discussed herein, several features are beneficial in using the nanofluidic cell 10 according to embodiments. FIG. 4 is a schematic of an open sandwich view of a nanofluidic cell 10 with a radial design according to an embodiment.

In FIG. 4, the connector plate 14 has a radial connector portion 404, and the mounting base 12 may have a radial portion 406 aligned to coincide with the radial connector portion 404 of the connector plate 14 when the face of the connector plate 14 is placed on top of the face of the mounting base 12 (like a closed sandwich).

The radial connector portion 404 is configured with a curvature (e.g., circular shape) that allows multiple micro-connectors to be hooked to the micro-connector ports 20A, 20B of the nanofluidic cell 10 at one time. The input micro-connector ports 20A of the radial connector portion 404 allows for the multiple fluid input operation.

The radial connector portion 404 allows enough room to accommodate different size micro-connectors for different applications, while each radial feed/capillary line of the input micro-connector ports 20A connects to its own input hole 22A, such that input hole 22A interfaces with its own hole 24A, 26A on the chip 18. In one implementation, the radial connector portion 404 may extend from an edge of the connector plate 14 a distance D1 in the y-axis, and the distance D1 may range from 1-2 centimeters (cm). The radial connector portion 404 does not require a larger distance separating the input holes 22A from each other in the x-axis (separating the input holes 22B from each other), as compared to a non-radial design (such as shown in FIGS. 2 and 3). The radial design having the radial connector portion 404 and the non-radial design may both have a separation distance D2 in the x-axis between the input holes 22A (output holes 22B), and the separation distance D2 may be 5-6 mm in one implementation. The radial design having the radial connector portion 404 does not increase the spacing (i.e., separation distance D2) between the input holes 22A, although the radial connector portion 404 can accommodate multiple micro-connectors. In one implementation, the radial design having the radial connector portion 404 may simultaneously accommodate (i.e., receive fluid input) multiple micro-connectors (e.g., six in this example), and each micro-connector may have a diameter of 3-4 millimeter (mm) in the x-axis. While maintaining the same separation distance D2 between the input holes 22A (along with output holes 22B), a non-radial design is not able to simultaneously connect the same number of multiple micro-connectors to the cell. The radial connector portion 404 allows all six of the nanofluidic devices 102 to be run simultaneously. Although formed as a semicircle, the radial connector portion 404 may have a diameter D3 (or width) in the x-axis as 3.2-3.8 cm in one implementation. The diameter of the radial section, R1, can be on the order of 3-5 cm in one implementation.

Figure 12A:
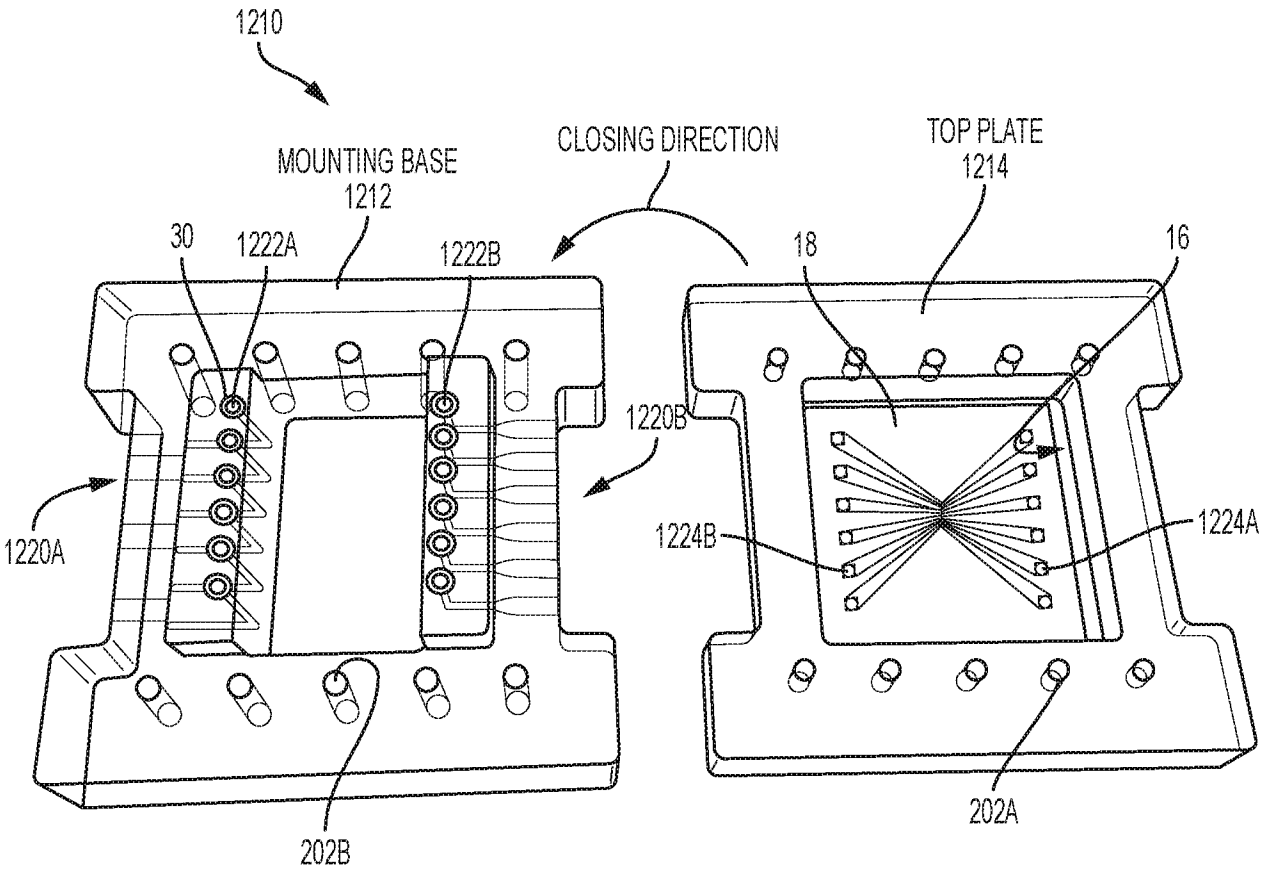
FIG. 12A is a schematic of a nanofluidic cell according to an embodiment.
Figure 12B:
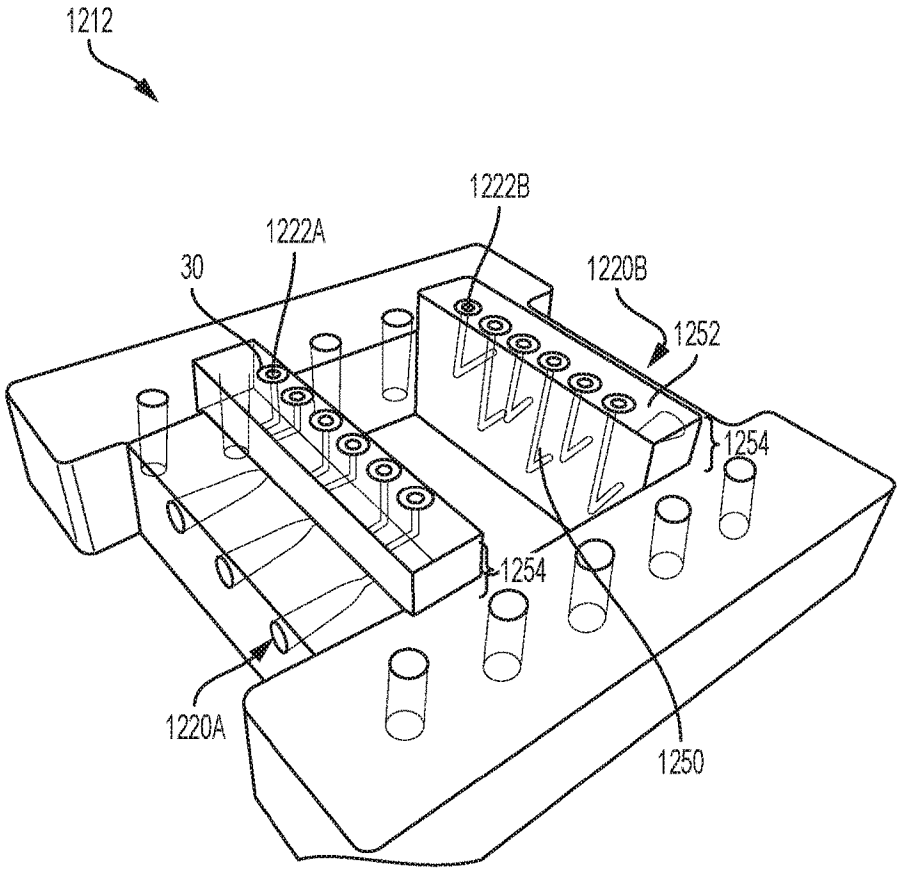
FIG. 12B is a schematic of a mounting base of the nanofluidic cell in FIG. 12A at a different orientation according to an embodiment.

FIG. 12A is a schematic of an open sandwich view of a nanofluidic cell 1210 according to an embodiment. FIG. 12B is a schematic of a mounting base 1212 of the nanofluidic cell 1210 as viewed from a different angle according to an embodiment. This nanofluidic cell 1210 allows fluid to be introduced to the backside of a nanofluidic chip 18, as opposed to the front side. This cell 1210 can be used for nanofluidic chips 18 in which fluidic holes have been fabricated through the wafer thickness, allowing liquid to be transferred from the back of the chip 18, via these holes, to the front of the chip 18 where nanofluidic networks can be accessed. This configuration allows the top of the chip 18/cell 1210 to be uncluttered/unobstructed by fluidic connections (e.g., micro-connectors), thereby allowing more room for optical or spectroscopic evaluation of the chip operation, e.g., as needed for quality control assessment or in situ diagnostics. In FIGS. 12A and 12B, the mounting base 1212 holds all of the micro-connector ports 1220A and 1220B and holes 1222A and 122B that interface the chip 18. The top plate 1214 has an impression 1216 that holds the chip 18, and presses down and holds the chip 18 in place on top of the mounting base 1212, using compression provided by screws or other fasteners. In one implementation, screws or fasteners may be attached through holes 202A and 202B. The mounting base 1212 comprises of a set of micro-connector ports 1220A, 1220B and their field lines 1250, which extend from the sides (i.e., from micro-connector ports 1220A, 1220B) of the mounting base 1212 up into O-ring seats 1252 (similar to O-ring sets 302) on a pedestal 1254 which conforms to the impression 1216 in the top plate 1214. When loaded with a nanofluidic chip 18, the pedestal 1254 and O-rings 39 contact with the chip 18 and form the clamping mechanism, along with the top plate 1214, to hold the chip 18 in place. The O-ring seats 1252 and holes 1222A, 122B co-locate with the hole pattern (of holes 1224A, 1224B) on the back of the nanofluidic chip 18, and provide the interface between the cell fluidics and the chip nanofluidics.

Figure 13B:
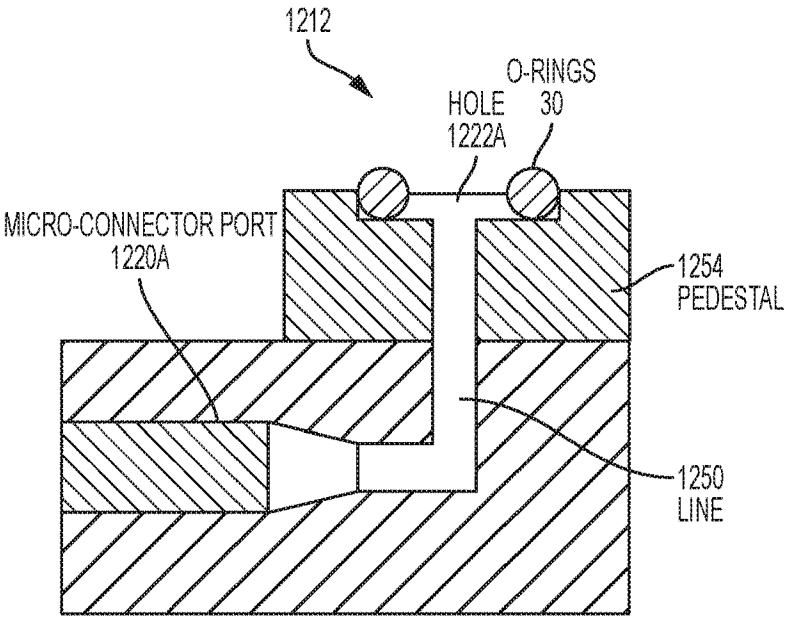
FIG. 13B is a schematic of a cross-sectional view of the mounting base cut at the plane in FIG. 13A according to an embodiment.
Figure 13A:
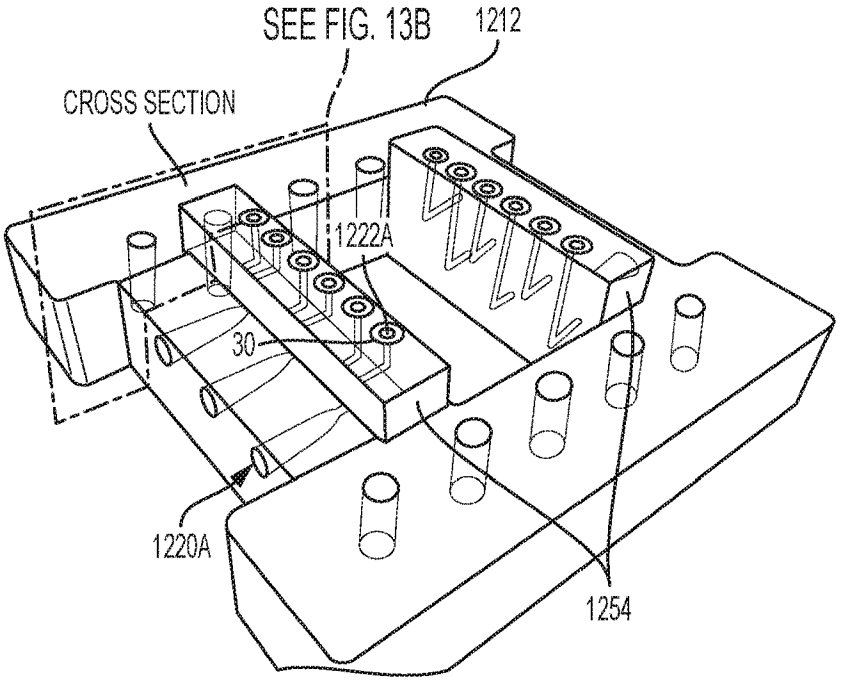
FIG. 13A is a schematic of the mounting base in FIGS. 12A and 12B, which illustrates a plane from which a cross-sectional view is to be taken according to an embodiment.

FIG. 13A is a schematic of the mounting base 1212 showing that a cross-sectional view is taken across one of the pedestals 1254, and FIG. 13B is a partial cross-sectional view of the mounting base 1212 which shows the pedestal 1254. In FIG. 13B, a fluidic port 1220A and feed line 1250 are from the back side fluidic cell 1210. The hole 1222A is aligned to communicate fluid with the hole 1224A of the nanofluidic chip 18. Although the cross-sectional view only illustrates a single pedestal 1254, it is appreciated that the other pedestal 1254 would have an analogous cross-sectional according to its orientation.

Figure 14:
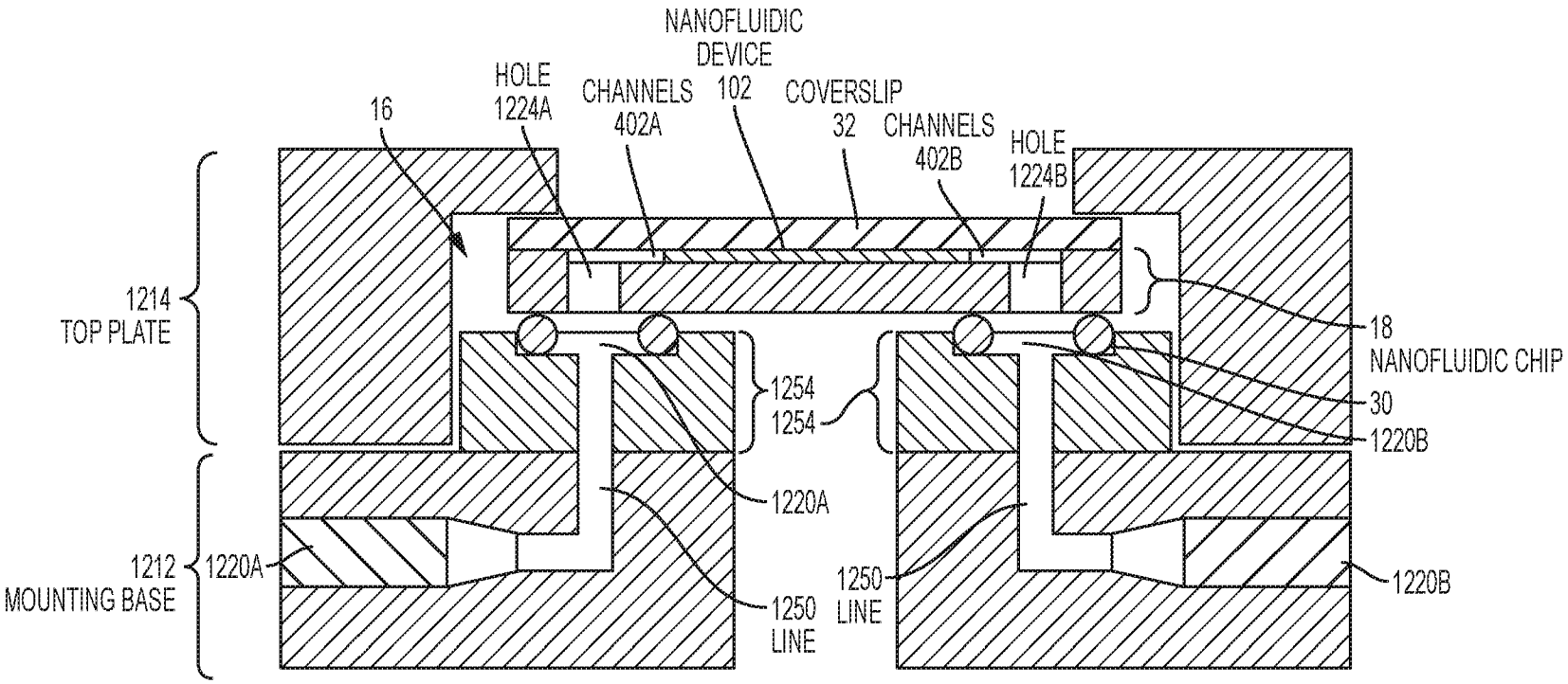
FIG. 14 is a cross-sectional view of the assembled nanofluidic cell in FIG. 12A loaded with a nanofluidic chip according to an embodiment.

FIG. 14 is a cross-sectional view of the nanofluidic cell 1210 loaded with the nanofluidic chip 18 according to an embodiment. As can be seen, FIG. 14 shows the top plate 1214 on top of the mounting base 1212 with the nanofluidic chip 18 compressed in between. The micro-connector ports 1220A, 1220B are connected to their respective lines 1250, and the lines 1250 connect to respective holes 1220A, 1220B in the pedestals 1254. The holes 1220A and 1220B connect to the nanofluidic device 18 via respective chip holes 1224A, 1224B and micro/nanochannels 402A, 402B. In one case, nanofluidic cell 1210 is configured such that fluid may flow into the micro-connector port 1220A, through line 1250, up through hole 1220A in pedestal 1254, up through hole 1224A, through channel 402A, through nanofluidic device 102, out through channel 402B, down through hole 1220B, down line 1250 and out micro-connector port 1220B. It should be appreciated that this process occur simultaneously for multiple corresponding micro-connector ports 1220A, 1220B, lines 1250, holes 1220A, 1220B, channels 402A, 204B, and nanofluidic devices 102.

In loading nanofluidic chips into the cell and priming the chips with fluid, one of the particular issues is the introduction of bubbles into the connections, leading to stoppage of the fluid flow due to the high hydrodynamic resistance of the bubbles. This is especially of concern with nanofluidic devices, since even larger input pressures, which would normally clear the bubbles in microfluidic systems, are not sufficient. The pressure difference $\Delta P$ across a bubble's surface is inversely proportional to its radius, r: $\Delta P \sim 2\gamma/r$, which implies that smaller sized bubbles have a greater pressure difference. For a water/air surface tension, $\gamma=72$ $mNm^{-1}$ (milliNewton/meter), for a bubble of r=1 μm, the $\Delta P \sim 3$ atm (standard atmosphere), three times the atmospheric pressure. At r=500 nm, $\Delta P \sim 6$ atm. To compress and eliminate a bubble requires an applied pressure equal to $\Delta P$, which can be difficult to obtain within the nanofluidic network. Alternatively, bubbles can be purged by flowing them out of the array; however, this is hampered by the fact that the bubbles have hydrodynamic capacitance, which acts to reduce the effective pressure in the array and slow down the fluid flow, making it difficult to clear them. Strong surface interactions can also pin and stabilize bubbles within the nanofluidic structures, increasing the pressure/flow needed to drive the bubbles out. In addition, the flow rate, Q, in a nanofluidic channel scales by the fourth power of the channel width, w: $Q \propto w^4$ for a given $\Delta P$, so that as the channel width is reduced to the nanoregime, the flow through the channel drops substantially, making it difficult to clear bubbles. Overall, avoidance of bubble entrainment within the nanofluidic chip is optimal because once bubbles enter the fluidic network, it may be difficult to remove the bubble, therefore diminishing or halting device operation.

Figure 5:
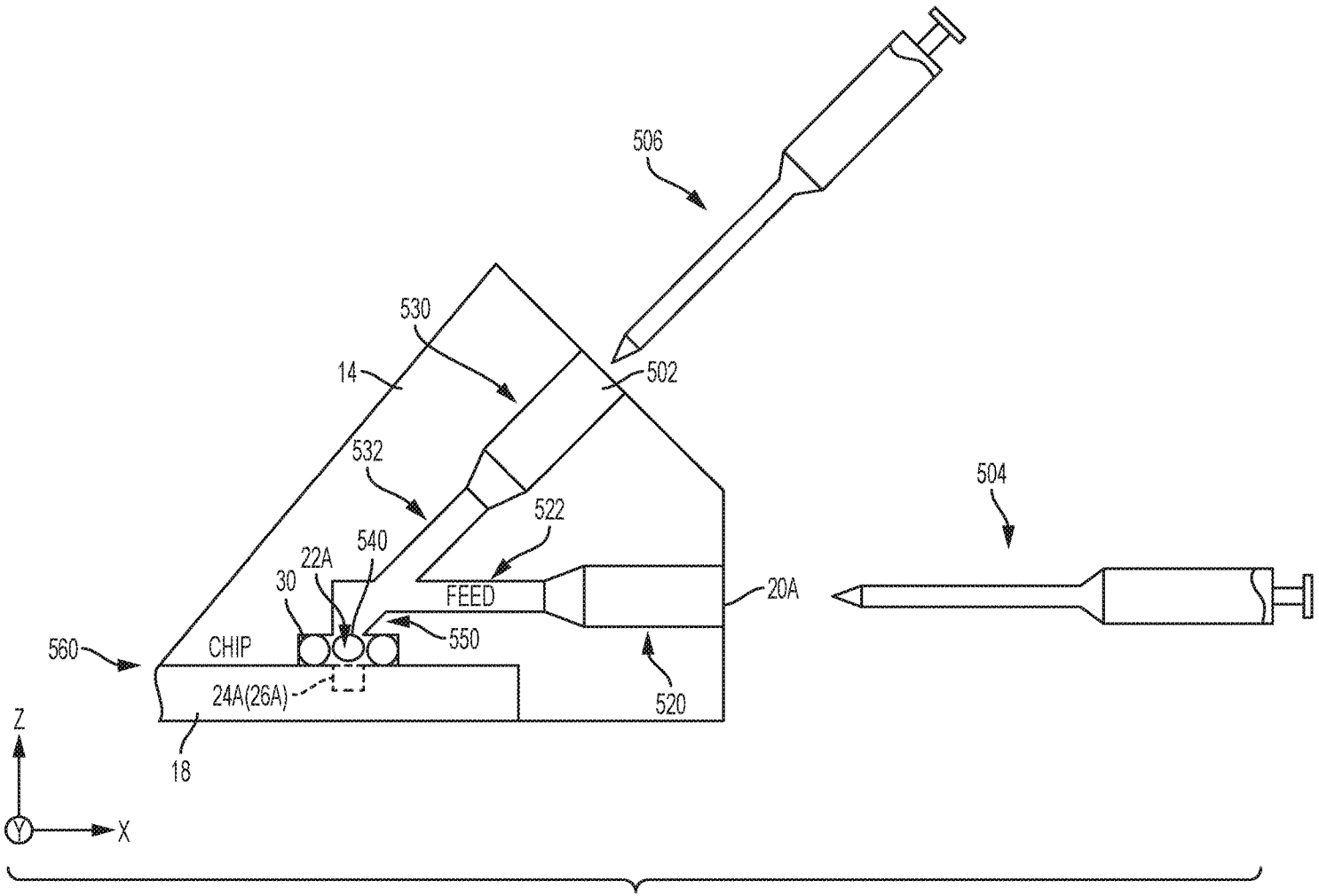
FIG. 5 is a cross-sectional view of a first type of connector plate designed to eliminate air bubbles according to an embodiment.
Figure 6:
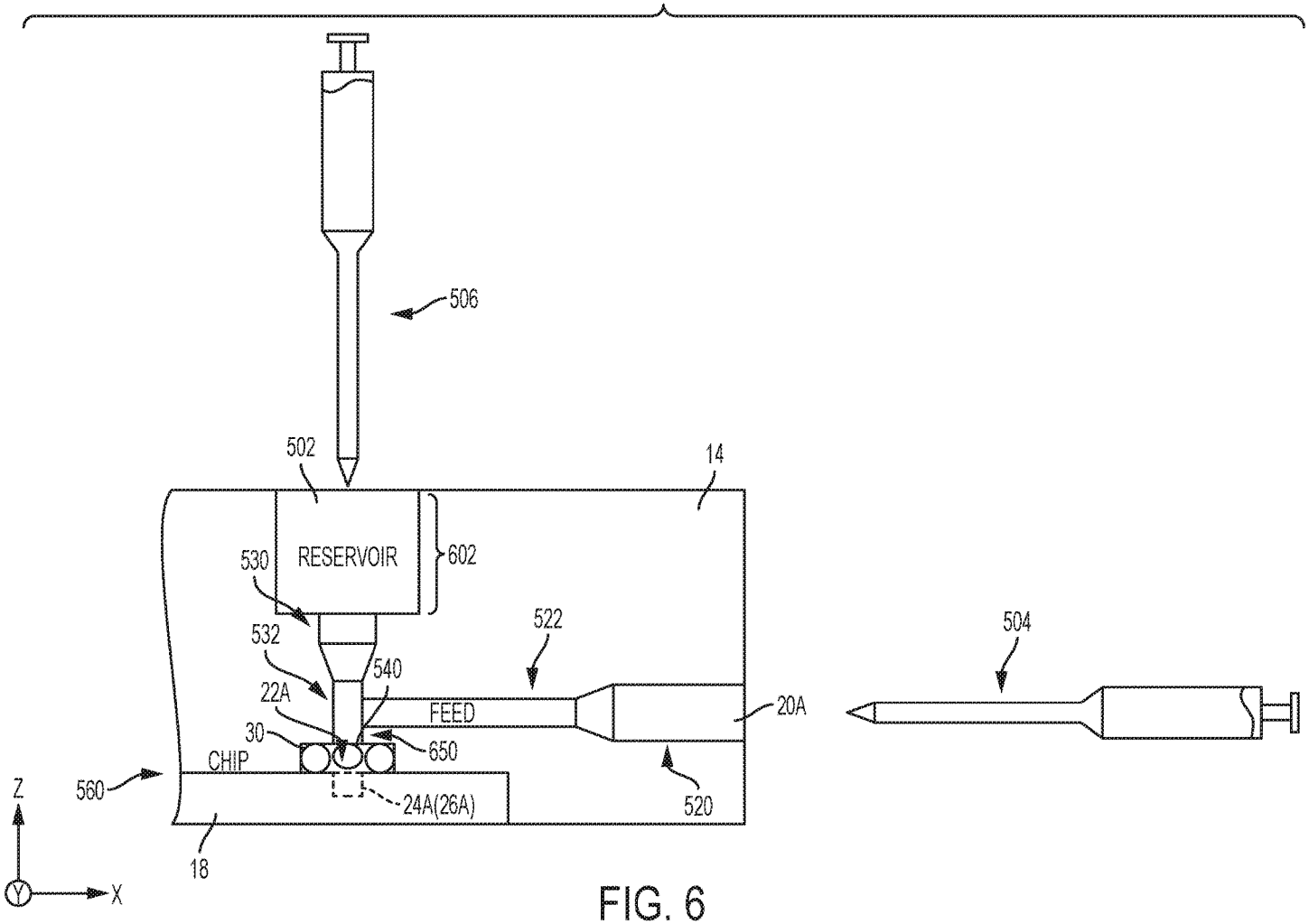
FIG. 6 is a cross-sectional view of a second type of connector plate designed to eliminate air bubbles according to an embodiment.

Now turning to FIGS. 5 and 6, design elements are illustrated for the removal of air pockets or air bubbles according to embodiments. FIGS. 5 and 6 are abbreviated views and it is understood that additional elements in FIGS. 1-4 may be included in FIGS. 5 and 6. Also, although only one micro-connector port 20A is shown with the air removal design, it is understood that each micro-connector port 20A is configured with the air removal design elements.

FIG. 5 is a cross-sectional view of the connector plate 14 with design elements to eliminate air bubbles according to an embodiment. In FIG. 5, the bubble-removal elements include a set of two ports, micro-connector lower port 20A and upper port 502, configured to allow fluid to be flushed (via a micro-connectors 504 and 506) from the lower port 20A up through the upper port 502 to purge any air bubbles in the feed lines 522 or 532. Further, the upper port's bore is large enough so that the micro-connector 506 (e.g., a tube or syringe) can reach to the chip interface 560 and extract out any bubble 540 that forms within the O-ring 30 and/or in the input hole 22A.

The micro-connector lower ports 20A may include and/or be connected a larger line 520 and smaller line 522, and the micro-connector upper ports 502 may include and/or be connected to a larger line 530 and smaller line 532. In one implementation, the diameter of the larger line 520 and the lager line 530 may range from about 3-4 mm. In one implementation, the diameter of the smaller line 522 and the smaller line 532 may range from about 0.5-1.0 mm.

The two micro-connector lower and upper ports 20A and 502 intersect to form a tee junction 550 at their intersection. Fluid is introduced into the lower port 20A and allowed to wet up to the chip interface 560 (between the chip 18 and the connector plate 14). Although the nanofluidic chip 18 may have the chip coverslip 32, the chip coverslip 32 is considered as part of the chip 18 and is not shown in FIGS. 5 and 6. To drive bubbles form the feed lines 522 and 532, the micro-connector port 502 is left open to atmosphere and fluid is introduced through micro-connector port 20A. Fluid, with any entrained bubbles, is pushed through the feed line 522 to the junction at 550. The nanofluidic chip 18 has such a substantially higher fluidic resistance compared to feed line 532 (since fluidic resistance is inversely proportional to the fourth power of the channel width/radius). Therefore, effectively all of the fluid is pushed from feed line 522 to 532 and out through micro-connector port 530. Any bubbles within this path are pushed out with the fluid.

Typically, a single air bubble 540 forms within the hole 22*a* at the chip interface 560, effectively blocking the fluid flow into the chip 18 (i.e., block fluid flow into holes 24A, 26A). This is eliminated through the upper port 502 that is designed with a bore (lines 530 and 532) wide enough so that a micro-connecter 506 (e.g., syringe, pipet tip, tube, etc.) can be inserted down to the chip 18, and the remaining air bubbles 540 sucked out. This clears the entire feed (including the lines 530, 532 and lines 520, 522, along with the tee junction 550) of any air bubbles and allows uninhibited injection of sample into the chip 18. The sample is the fluid (e.g., a buffer) containing the nanoparticles to be tested by the nanofluidic device 102. Samples may be loaded through the upper port 502 by directly injecting at the chip interface 560 (e.g., in and/or through the hole 22). The upper port 502 may be sealed or capped off to allow pressurization of the fluid path during operation. The arrangement of the two ports 20A and 502 can be set at any angle so as to allow clearance for imaging equipment 110 to approach the chip 18 in the nanofluidic cell 10. A different arrangement for the two ports 20A and 502 is illustrated in FIG. 6.

FIG. 6 is a cross-sectional view of the connector plate 14 with design elements to eliminate bubbles according to another embodiment. FIG. 6 includes the elements of FIG. 5, and the discussion for FIG. 5 analogously applies to FIG. 6. Additionally, in FIG. 6, the upper micro-connector port 502 includes a reservoir 602 positioned above the input hole 22 and chip 18. As discussed herein, fluid can be flushed through the lower micro-connecter port 20A (via micro-connector 504) up through the reservoir 602 to purge any bubbles in the feed line (e.g., lines 530, 532 and lines 520, 522). The sample (e.g., in micro-connector 506) can be loaded directly into the reservoir 602, or through the reservoir 602 (and through hole 22) using a syringe or tube (e.g., micro-connector 506) to inject the sample directly at the chip interface 560. Any bubbles 540 that result from sample injection and/or extraction rise up into the reservoir 602 and do not block the feed line (particularly the hole 22A) during operation. In one embodiment, the reservoir 602 may have a width of approximately 1-10 mm, although smaller or larger reservoirs can be implemented depending on requirements/constraints. The benefit of the reservoir 602 is the ability to have a larger opening for accessing the entrapped bubble 540 at hole 22A, increasing the ease/rate of success of clearing the nanofluidic port's interface. The reservoir 602 also acts a buffer during operation, in that if any bubbles are entrained within the fluid flow from micro-connector 20A, the bubbles can rise and be sequestered within the reservoir 602 while fluid flow/pressure is still applied to the nanofluidic chip 18.

In FIGS. 5 and 6, it is noted that the angle of the micro-connector upper port 502 provides a direct line-of-sight directly down to and through the hole 22, such that the chip interface 560 between the chip 18 (having coverslip 32) and the connector plate 14 is reached by the tip of the micro-connector 506. In one case, the angle of the micro-connector upper port 502 may be measured from the horizontal chip interface 560 to a center line along the length of the upper port 502. In FIG. 6, the angle of the micro-connector upper port 502 is approximately 90° relative to the horizontal chip interface 560 in one implementation. In another implementation, the angle of the micro-connector upper port 502 may range from approximately 30-90° relative to the horizontal chip interface 560.

Of particular interest in nanofluidic devices on a chip is the device density, in which more nanofluidic devices can be placed per area on a nanofluidic chip, with the inputs/outputs of these nanofluidic devices linked to allow more sophisticated manipulations. This can lead to more robust or complex analyses, diagnostics, or processing operations on chip 18. To obtain high densities, nanofluidic devices are shrunk down and spaced closer together. This introduces the problem of interfacing between the chip 18 and the external environment, both because the inputs are small (small sized holes and feeds) and spaced closer together. According to an embodiment, the cell designs discussed herein may be integrated together to produce a hierarchical approach, in which several connector plates are stacked together to allow a step-wise integration of macroscopic inputs (e.g., of fluid samples), microscale feeds, and nanoscale devices.

Figure 7A:
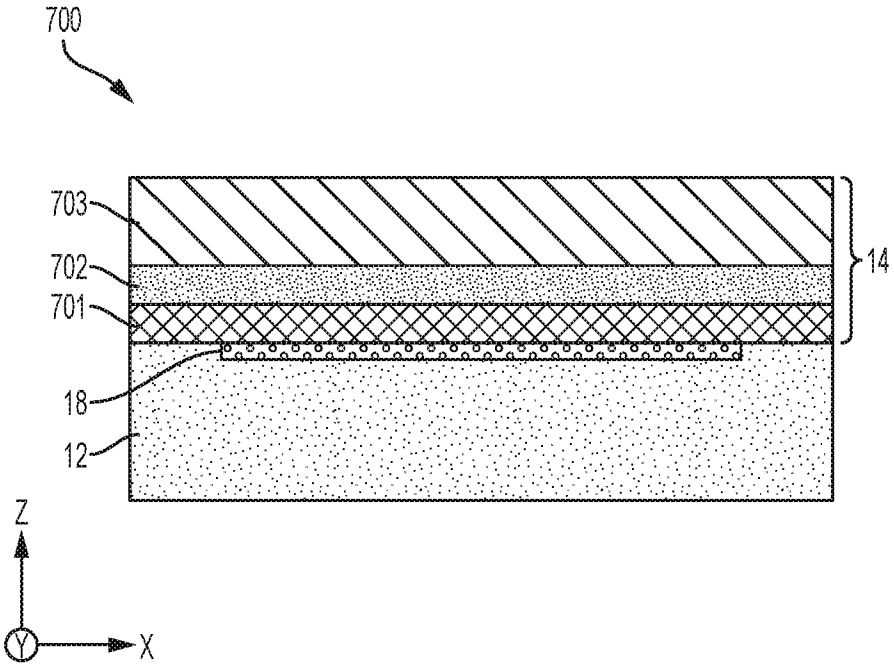
FIG. 7A is a schematic of a cross-sectional view of a nanofluidic cell with a three-tier stack of connector plates according to an embodiment.
Figure 7B:
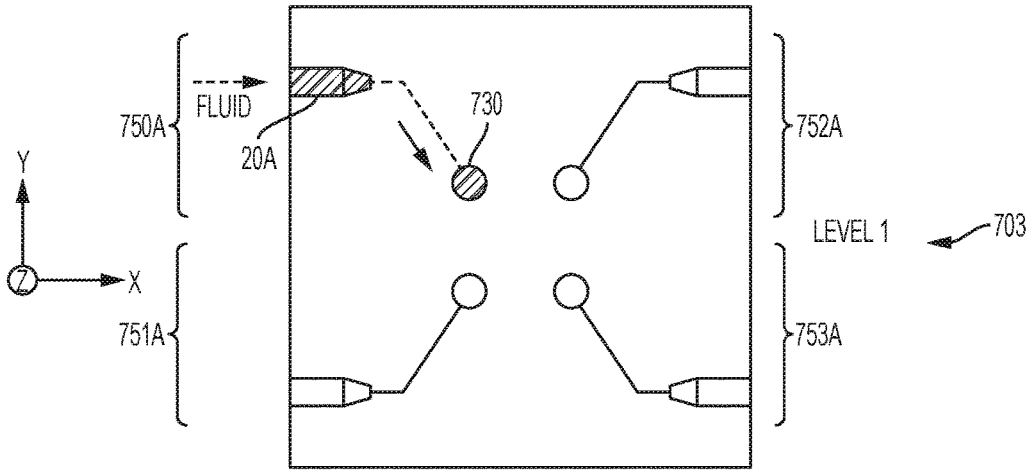
FIG. 7B is a schematic of a top-down view of a top connector plate in the three-tier stack according to an embodiment.
Figure 7C:
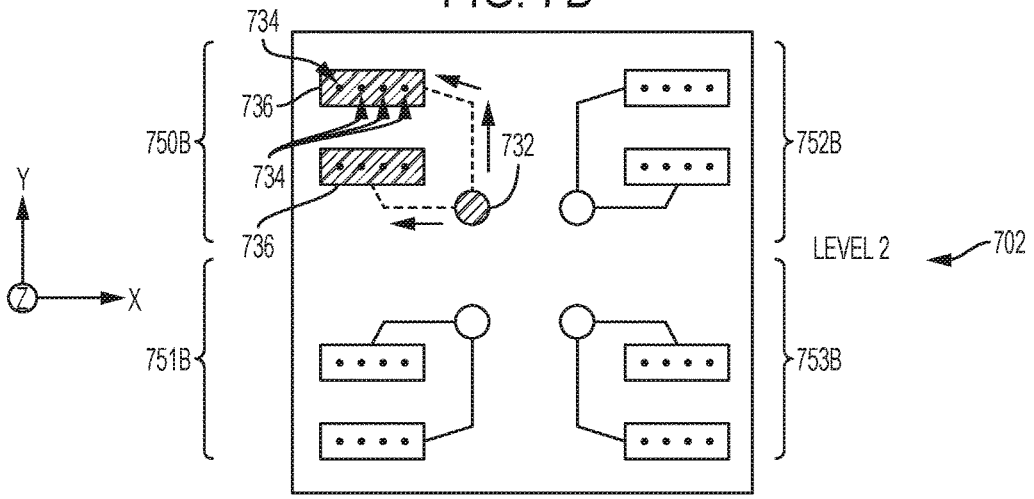
FIG. 7C is a schematic of a top-down view of a middle connector plate in the three-tier stack according to an embodiment.
Figure 7D:
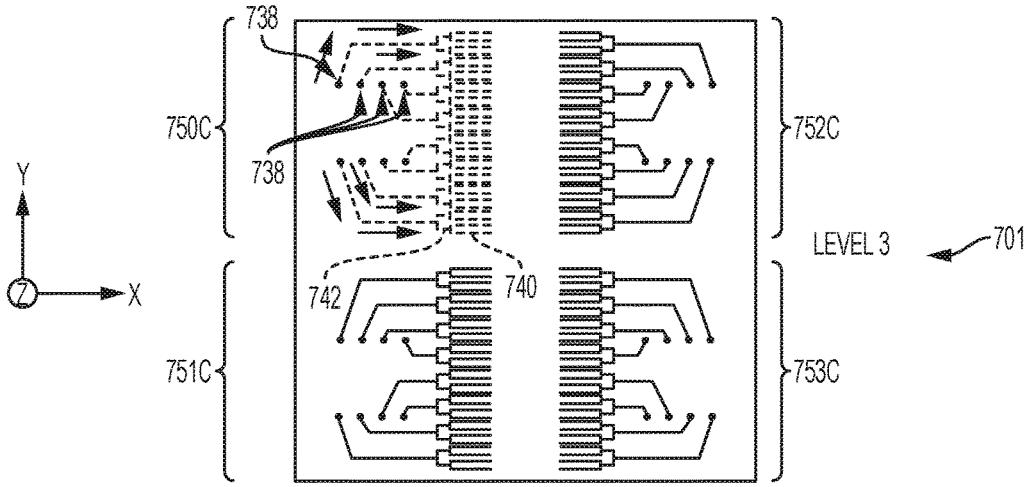
FIG. 7D is a schematic of a top-down view of a bottom connector plate in the three-tier stack according to an embodiment.
Figure 7E:
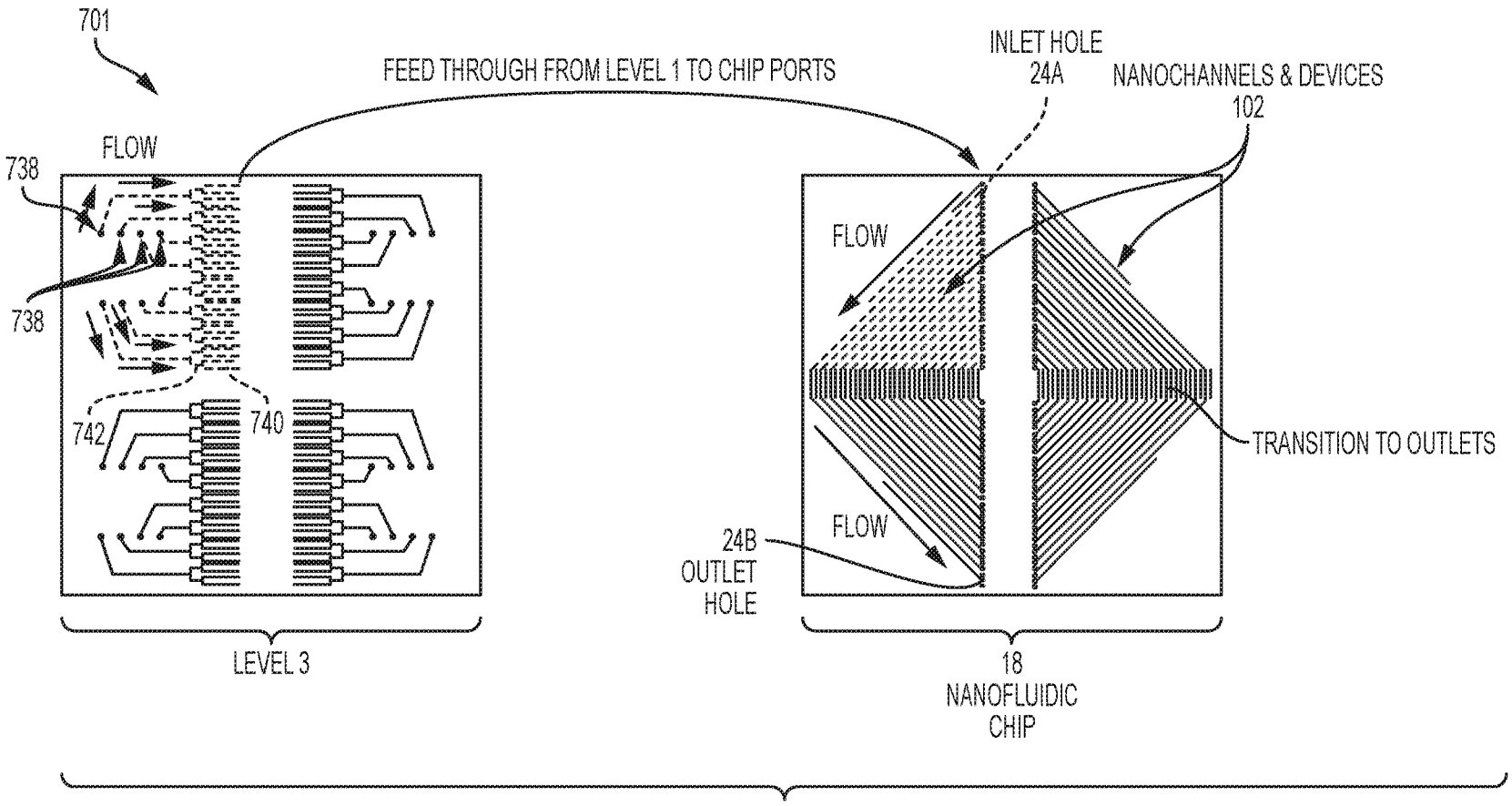
FIG. 7E is a schematic illustrating the feed through from the bottom connector plate to the nanofluidic chip according to an embodiment.

As a step-wise integration macroscopic inputs of fluid, microscale feeds, and nanoscale devices, FIG. 7A is a schematic of a cross-sectional view of a nanofluidic cell 700 with a three-tier stack of connector plates 14 according to an embodiment. FIGS. 7B through 7D are top views of each of the connector plates 14 according to an embodiment. FIG. 7E is a schematic illustrating the fluid flow from the lowest level connector plate 14 to the example nanofluidic chip 18.

The nanofluidic cell 700 is an example of a multi-connector plate stacked cell for stepping down fluid inputs for high density device interfacing. Stepping down fluid inputs means transferring fluid from a larger (wider) channel into multiple smaller (narrower) channels, effectively allowing a single input stream of fluid to be distributed to many smaller channels that can then feed into a larger number of nanofluidic devices. The practical motivation for this design is to allow a small number of macroscopic inputs (e.g., from micro-connectors that can be easily attached and controlled by an operator) to be used to operate a larger number of nanofluidic devices simultaneously. To explain further by way of an example, assume a standard micro-connector has an effective footprint of approximately 5 $mm^2$. If each nanofluidic device had to be plumbed to its own micro-connector, this implies a device density of approximately 20 devices/$cm^2$, assuming a square lattice packing of connectors. However, a typical nanofluidic separator device footprint can be approximately 0.025 $mm^2$, giving a device density of approximately 4,000 devices/$cm^2$. Using a one-to-one correspondence of micro-connector to nanofluidic device would use 0.5% of the available chip surface. One solution is to use smaller micro-connectors, but this requires physically connecting larger banks of micro-connectors to input ports. The same effect can be realized by producing the "small micro-connectors" within the cell itself, and using larger micro-connectors to feed fluid to these ports according to embodiments. Accordingly, embodiments provided configurations of stepping down fluid in stages to distribute sample to high densities of nanofluidic devices.

Referring to FIG. 7A, the schematic shows a three-tier example of a bottom connector plate 701, a middle connector plate 702, and a top connector plate 703, which together form the multiple state/stage connector plate 14. Although a three-tier example is provided for explanation purposes, it is appreciated that some implementations may include 4, 5, 6, 7, etc., tiers.

In the multiple state connector plate 14, fluid samples are injected through/into micro-connector ports 20A (using micro-connectors (such as micro-connectors 504 and 506)) into the top connector plate 703 (level 1). This top connector plate 703 has millimeter wide feeds 730 (i.e., holes) which flow fluid into through vias 732 of a middle connector plate 702, thereby injecting fluid into the middle connector plate 702 (level 2). In one implementation, the feeds 730 may be approximately 2 millimeters (mm) in diameter, and correspondingly, the through vias 732 receiving the fluid in the middle connector plate 702 may be approximately 2 millimeters (mm) in diameter. In another implementation, the diameter of the feeds 730 may range from about 2-3 mm, and correspondingly, the diameter of through vias 732 in the middle connector plate 702 may range from about 2-3 mm. In one implementation, the micro-connector ports 20A may be have a diameter that ranges from 3-4 mm. In this example, four micro-connector ports 20A connected by respective lines to holes 730 are shown. It is appreciated that more or fewer micro-connector ports 20A can be utilized.

At the middle connector plate 702 (level 2), the fluid is distributed from the through vias 732 into reservoirs 736 having micron wide feeds 734. The feeds 734 inject fluid into through vias 738 in a bottom connector plate 701 (level 3). In other words, the middle connector plate 702 comprises a set of reservoirs 736 that distribute the feed of fluid from the through vias 732 into a series of holes 734. The holes 734 feed into the bottom connector plate 701. In one implementation, the feeds 734 may be approximately 10 microns (μm) in diameter, and correspondingly, the through vias 738 receiving the fluid in the bottom connector plate 701 may be approximately 10 μm in diameter. In another implementation, the diameter of the feeds 734 may range from about 0.2-1 mm, and correspondingly, the diameter of through vias 738 in the bottom connector plate 701 may range from about 0.12-1 mm. Although two reservoirs 736 connected by respective lines to through via 732 are shown in this example, it is appreciated that more or fewer reservoirs 736 may be utilized, and each reservoir 736 may have fewer or more than four feeds 734. In one implementation, the reservoirs 736 may have a width in the x-axis of about 1-10 mm, a depth in the y-axis of about 1-10 mm, and a height in the z-axis of about 500 nm up to 10 μm.

At the bottom connector plate 701 (level 3), through vias 738 distribute fluid from feeds 734 of the middle connector plate 702 into reservoirs 742 having nanometer wide feeds 740 (holes). The nanometer wide feeds 740 inject fluid into the nanofluidic chip 18. For example, the third plate reservoirs 742 fill with fluid and then feed, through nanometer holes 740, into holes 24A, 26A of the nanofluidic chip 18. In one implementation, the feeds 740 may be approximately 500 nm in diameter, and correspondingly, the holes 24A, 26A of the nanofluidic chip 18 may be approximately 500 nm in diameters. In another implementation, the diameter of the feeds 740 may range from about 0.12-0.4 mm, and correspondingly, the diameter of holes 24A, 26A in the nanofluidic chip 18 may range from about 0.12-0.4 mm. The stepping down and distributing of fluid by stages (levels 1-3) allows a high density of feed-ins (i.e., feeds 730, 734, 740), which in turn allows a high density of devices 102 on each nanofluidic chip 18. The use of multiple levels (stages) allows a geometric progression in the input distribution, allowing a practical method of building the flow cell and controlling the distribution density. In the embodiment in FIG. 7B, level 1 to level 2 increases the port density by 8×(i.e., 8 times), and from level 2 to level 3 increases the port density by 4×, leading to an overall increase in port density of 32×. This is only an example representation. It is contemplated that a larger increase can be obtained if, for example, each level increased the port density by 10×, so that after three levels a 1000× increase in port density could be obtained, allowing distribution of fluid to a device density of order approximately 1000 devices/$cm^2$. This can be achieved by decreasing the size of the holes 730, 732 and 736, 738 and increasing their density.

FIG. 7E illustrates the example nanofluidic chip 18 with input holes 24A and output holes 24B in a pattern mirroring the feeds 740 of the bottom connector plate 701, allowing each hole 24A, 24B to receive/distribute fluid from/to the connector plate holes. Fluid passes from an individual hole 740 in the bottom connector plate 701 through an inlet hole 24A in the nanofluidic chip 18, into a series of nanochannels/nanodevices where the actual function of the chip occurs. Processed fluid is passed through an outlet hole 24B, up into a separate hole on the bottom connector plate 701. This occurs simultaneous, continuously, and in parallel for all inputs and outputs 24A and 24B, effectively allowing the chip 18 to process liquid at a faster rate (larger volume for a given time). The layout of the channels/devices on the nanofluidic chip 18 in FIG. 7E shows only one possible design. It should be appreciated that any configuration and density of devices/channels/holes can be implemented with the same basic design principles for distributing/recollecting fluid using the stacked connector plates.

The above example scenario traces the distribution of fluid from one port 22A, showing the step-wise distribution of fluid. The example only illustrates the fluid distribution in, e.g., section 750A in the top connector plate 703, which feeds section 750B in the middle connector plate 702, which then feeds section 750C in the bottom connector plate 701. The section 750C in the bottom connector plate 701 feeds a corresponding section of holes 24A, 26A in the nanofluidic chip 18. Although sections 750A, 750B, and 750C are highlighted for explanation purposes, it is appreciated that sections 751A-751C, sections 752A-752C, and sections 753A-753C operate analogously as discussed for sections 750A-750C.

The stepping down (i.e., reduction) of the dimensions of the feeds 730, 734, 740 allows a smooth distribution of inputs from the practical-to-handle micro-connectors (e.g., micro-connectors 504, 506) in micro-connector ports 22A down to the high density microscopic holes (holes 734, 738, 740) and nanofluidic devices 102. The modularity of the plates 701, 701, 703 (which are various implementations of the connector plate 14) allows different stacks to be produced to handle different chips. The cell itself, consisting of the mounting base and connector plate stacks, may be made into a single housing module that can be used to encase and interface with the chip, and provide external connections for attachment to mobile devices or analytical equipment.

Figure 15B:
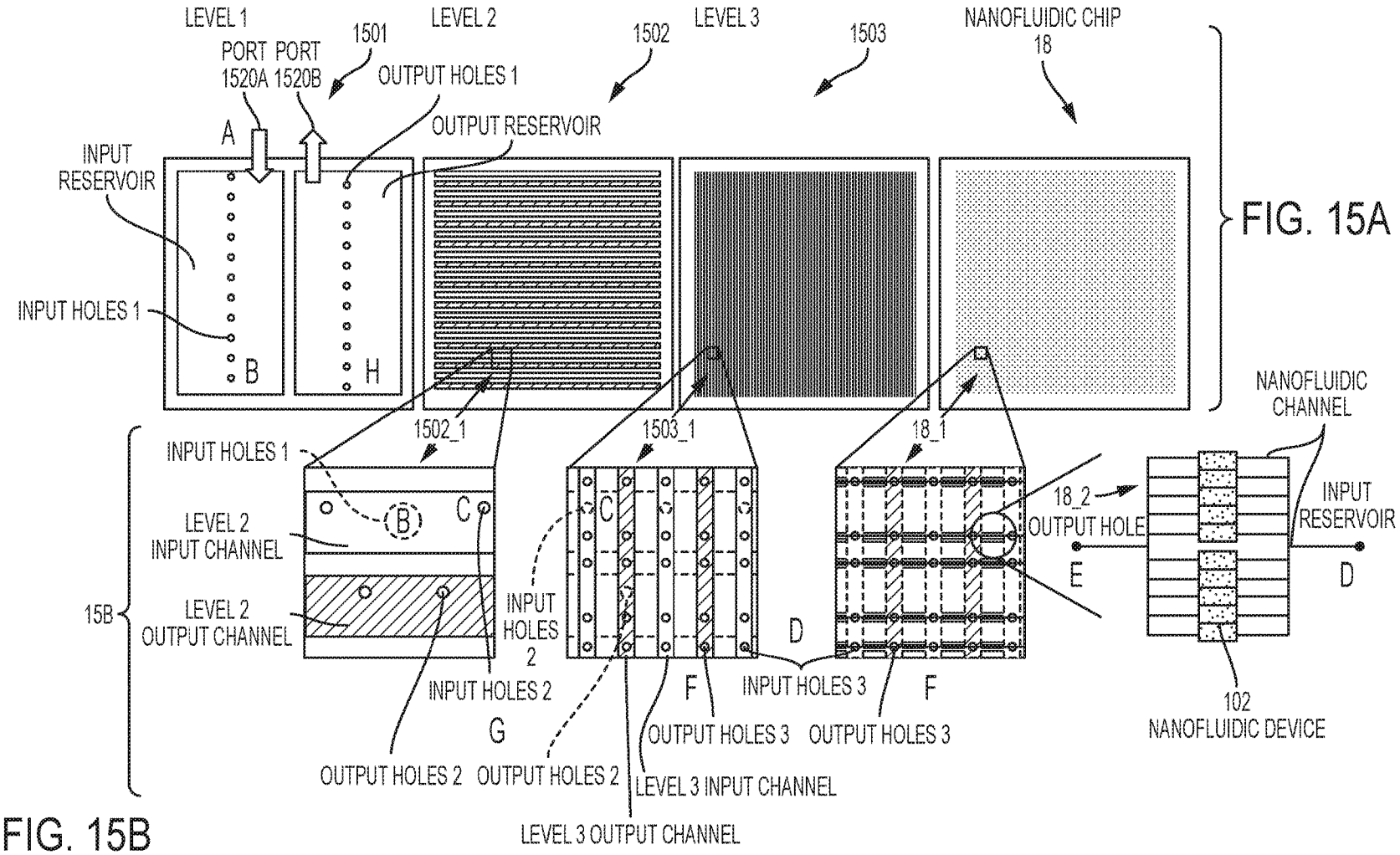

According to another embodiment, FIGS. 15A and 15B illustrate a schematic of an overhead view of a three-tier stack of connector plates 1501, 1502, 1503, used to obtain a high density of fluidic connections using only one input and one output micro-connector port 1520A and 1520B. Each connector plate level 1501, 1502, 1503 affords an approximately 10× increase in port density, giving a 1000× increase in the port density at the chip level, which matches the density of nanofluidic devices 102.

An enlarged view 1502_1 has been magnified to show a portion of the level 2 connector plate 1502. An enlarged view 1503_1 has been magnified to show a portion of the level 3 connector plate 1503. Similarly, an enlarged view 18_1 has been magnified to show a portion of the example nanofluidic chip 18. A further enlarged view 18_2 has been magnified to show a portion of the enlarged view 18_1.

In FIGS. 15A and 15B, the fluid flow follows the progression of letters A-H. For example, fluids flow into the input micro-connector port 1520A of the level 1 connector plate 1501, into the level 2 connector plate 1502, into the level 3 connector plate 1503, then into the nanofluidic chip 18 to be processed by the nanofluidic device 102, out through the nanofluidic chip 18, back into the level 3 connector plate 1503, back into the level 2 connector plate 1502, back into the level 1 connector plate 1501, and out through the output micro-connector port 1520B.

Figure 16:
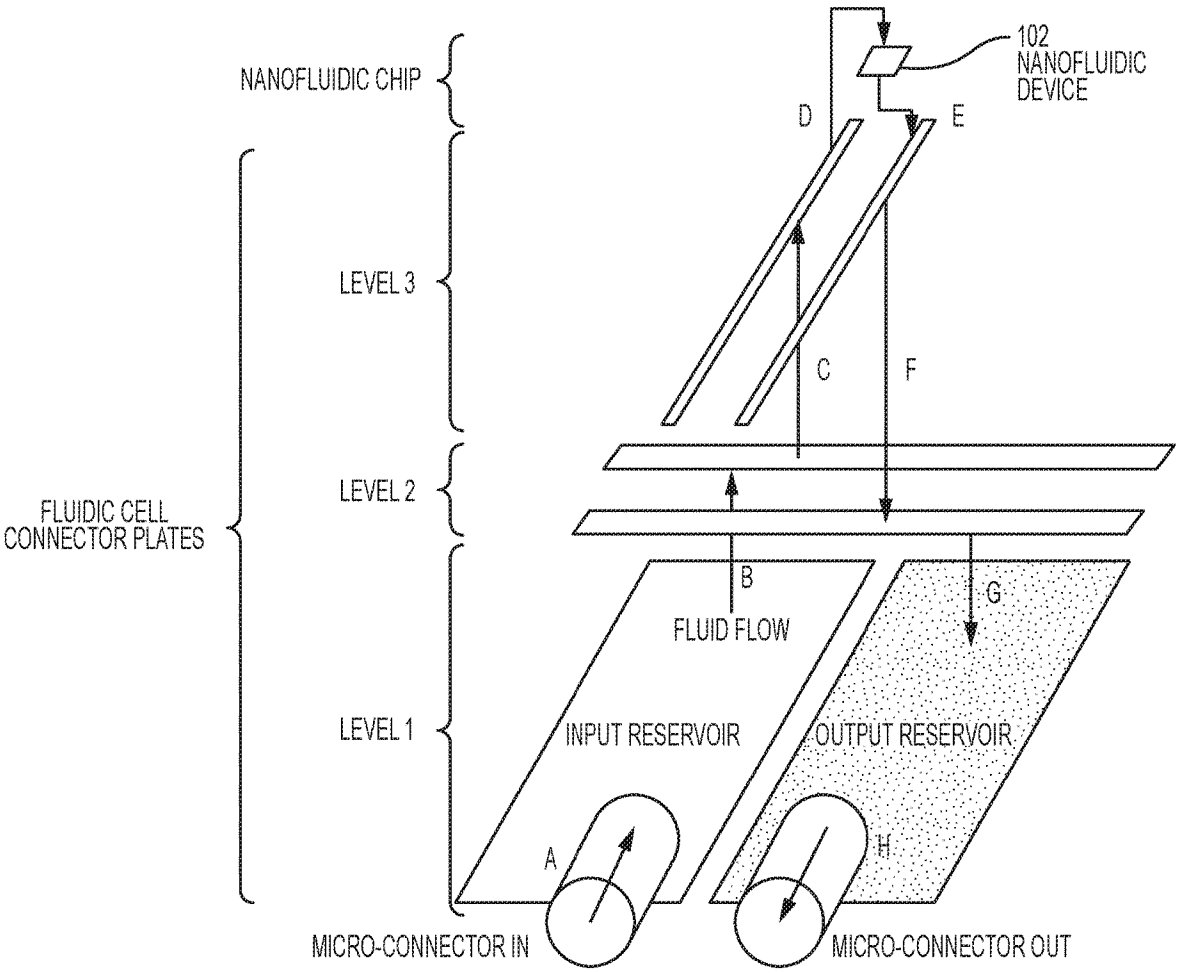
FIG. 16 is a schematic of the fluid flow between different levels of a nanofluidic cell according to an embodiment.

Now turning to FIG. 16, a schematic is shown of the direction of fluid flow between the different levels (connector plates) of the nanofluidic cell according to an embodiment. FIG. 16 illustrates the basic geometry of the channels for each level, which allows the distribution of fluid from level to level. The through holes have been omitted for clarity. Although the flow direction is shown as proceeding from the large volume level 1 upward to the fluidic devices 102 and then back down to exit at level 1, it should be appreciated that the orientation can be flipped arbitrarily.

Figure 8B:
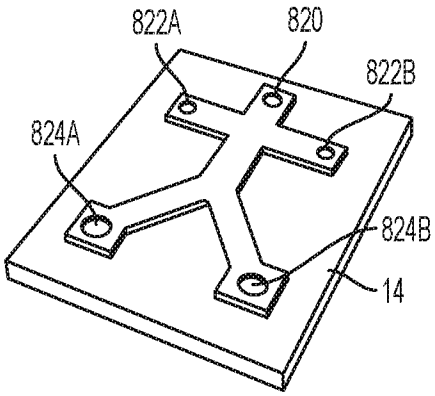
FIG. 8B is a schematic of the sealed multiplexing cell connector plate with multiple ports according to an embodiment.
Figure 8A:
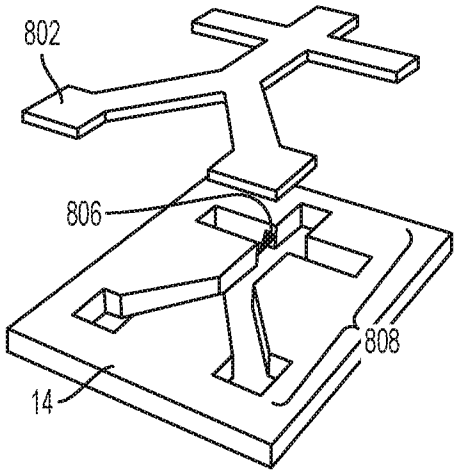
FIG. 8A is a schematic of fabricating a multiplexing cell connector plate with a pattern of channels according to an embodiment.

Within a connector plate 14 (such as connector plates 701, 702, 703), multiple feeds can be constructed to allow more advanced architectures for distributing, collecting, and mixing fluids outside the chip, and this is referred to as multiplexing. To illustrate multiplexing cells for distributing fluid samples, FIGS. 8A and 8B are schematics illustrating forming a multiplexing cell connector plate 14 with a desired pattern 808 of channels/lines 806 (connected to feeds) machined or etched into the surface of the connector plate 14 according to an embodiment. A feed network/pattern 808 is patterned into the connector plate 14, and a cover plate 802 is similarly patterned (but slightly larger) in order to be sealed to the top using an adhesive process.

The depth, connectivity, shape, and distribution of these channels 806 in the feed pattern 808 can be controlled through precise machining and/or lithography techniques. The resulting network of feeds is then sealed with the thin cover plate 802 using adhesive. The cover plate 802 is machined to fit exactly over the feed pattern 808, with a small trim that extends over the edge of the feed pattern 808. Particular to the sealing process is the ability to bond the cover plate 802 to the feed network/pattern 808 without contaminating or blocking pattern 808 with adhesive. The sealing process utilizes a careful application of a precise amount of selected adhesive to the rim of the cover plate 802, so that capillary force brings the adhesive just to the welding point of the connector plate 14 and cover plate 802. In one embodiment, the cell is produced from acrylate and sealed together using a solvent mixture of methylene chloride, trichloroethylene and methyl methacrylate monomer. The cover plate 802 is set on top of channel pattern 806 and the solvent mixture applied around the edge of 802 using a horse hair brush (typically 0.5 cm width). The solvent mixture capillary wicks into the crevice between the 802 and 806,808 surface. The amount of solvent applied to the brush and the amount applied to the 802 edge is modulated to ensure that the solvent wicks only to the joint of 802/806/808 and not into the cavity of 806 itself. By this method, complex connector plates 14 can be fabricated for multiplexing numerous fluid samples. As seen in FIG. 8B, the sealed connector plate 14 forms feed channels 806 that interconnect multiple ports 820, 822A, 822B, 824A, and 824B.

According to embodiments, multiplexing may be extended to include interconnecting cells 10 for distributed processing. The output of one cell 10 may be routed to another cell 10, allowing a modular design in which different nanofluidic chips 18, each carrying out a particular action such as separation or mixing, can be connected together to form a more complex process. In this manner, the cell/chip becomes a single module "building block" that can be connected together in different configurations for prototyping and product development. This can be useful for distributing functions. For example, in some cases, pumping and collection are not easy to implement on-chip, and therefore can be relegated to modules that are interlinked with cells/chips to form complete devices.

Figure 9B:
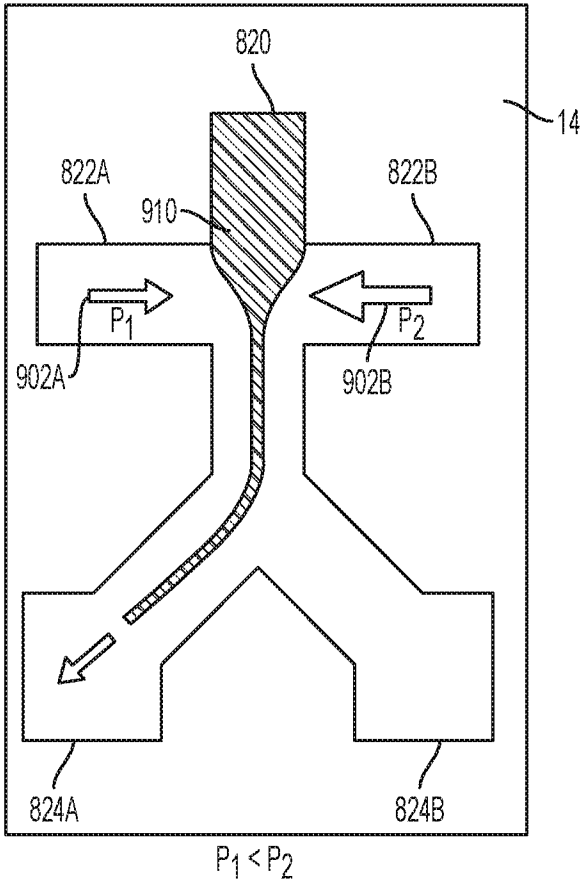
FIG. 9B is a schematic of a top-down view illustrating fluid flow in another direction utilizing a fluidic value according to an embodiment.
Figure 9A:
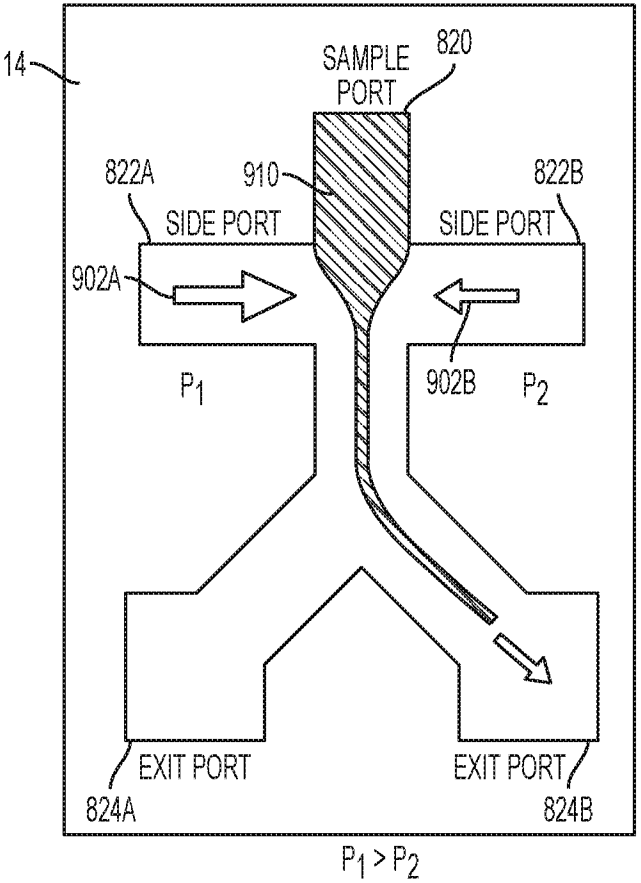
FIG. 9A is a schematic of a top-down view illustrating fluid flow in one direction utilizing a fluidic value according to an embodiment.

According to embodiments, a further design element is to incorporate valves, either micro-scale mechanical or electromechanical valves or fluidic valves. Micro-valves may comprise mechanical fittings such as plugs or screws, or more complicated multiple-port switches and tees. Fluidic valves may comprise junctions between feeds, where the path of the fluid is controlled by the relative pressure between each feed line. To illustrate a fluidic valve in a multiplexer connector plate 14, FIGS. 9A and 9B are schematics illustrating changing the pressures applied to a set of feed lines/channels 806, such that the fluid flow direction in the connector plate 14 may be adjusted to route samples to different parts of the chip 18 (not shown) connected to the connector plate 14. FIGS. 9A and 9B are top-down views that show the fluid flow inside as though the cover plate 802 is removed. As noted in FIGS. 8A and 8B, the sealed connector plate 14 forms feed channels that interconnect multiple ports 820, 822A, 822B, 824A, and 824B. The demonstration of the fluidic valve in the multiplexed connector plate 14 shows that sample fluid is introduced into a junction with two side port streams 902A and 902B, and two side port streams 902A and 902B sculpt the sample fluid into a jet. In the example of FIG. 9A, the pressure $P_1$ of the left side port stream 902A from side port 822A is greater than the pressure $P_2$ of the right side port stream 902B from side port 822B. The pressure differential ($P_1$–$P_2$) between the two side ports 902A and 902B determines which direction the sample jet is diverted. The sample fluid 910 is diverted to exit out of the exit port 824B in FIG. 9A.

Conversely, in the example illustrated in FIG. 9B, the pressure $P_1$ of the left side port stream 902A from side port 822A is less than the pressure $P_2$ of the right side port stream 902B from side port 822B. The pressure differential ($P_2$–$P_1$) between the two side ports 902A and 902B determines which direction the sample jet is diverted. The sample fluid 910 is diverted to exit out of the exit port 824A in FIG. 9B. By switching the pressure condition $P_1>P_2$ or $P_1<P_2$, the sample fluid 910 can be controllably diverted between two exit ports 824A, 824B, allowing control over the sample injection/extraction in the chip 18 according to an embodiment. These designs may be incorporated into any connector plate 14 using the cover plate sealing method described above in FIGS. 8A and 8B. The pressures $P_1$ and $P_2$ can be generated by several driving forces, including but not limited to a piston or syringe, electrophoresis, acoustics, mechanical pumping, chemical affinity, thermal gradients, surface chemical gradients or changes in the channel geometry.

The embodiments, consisting of the cell designs and their design elements, permit control of fluid sample delivery and extraction from nanofluidic cells and provide the interface and housing necessary for deploying nanofluidic chips into real world environments and mobile devices.

Figure 10:
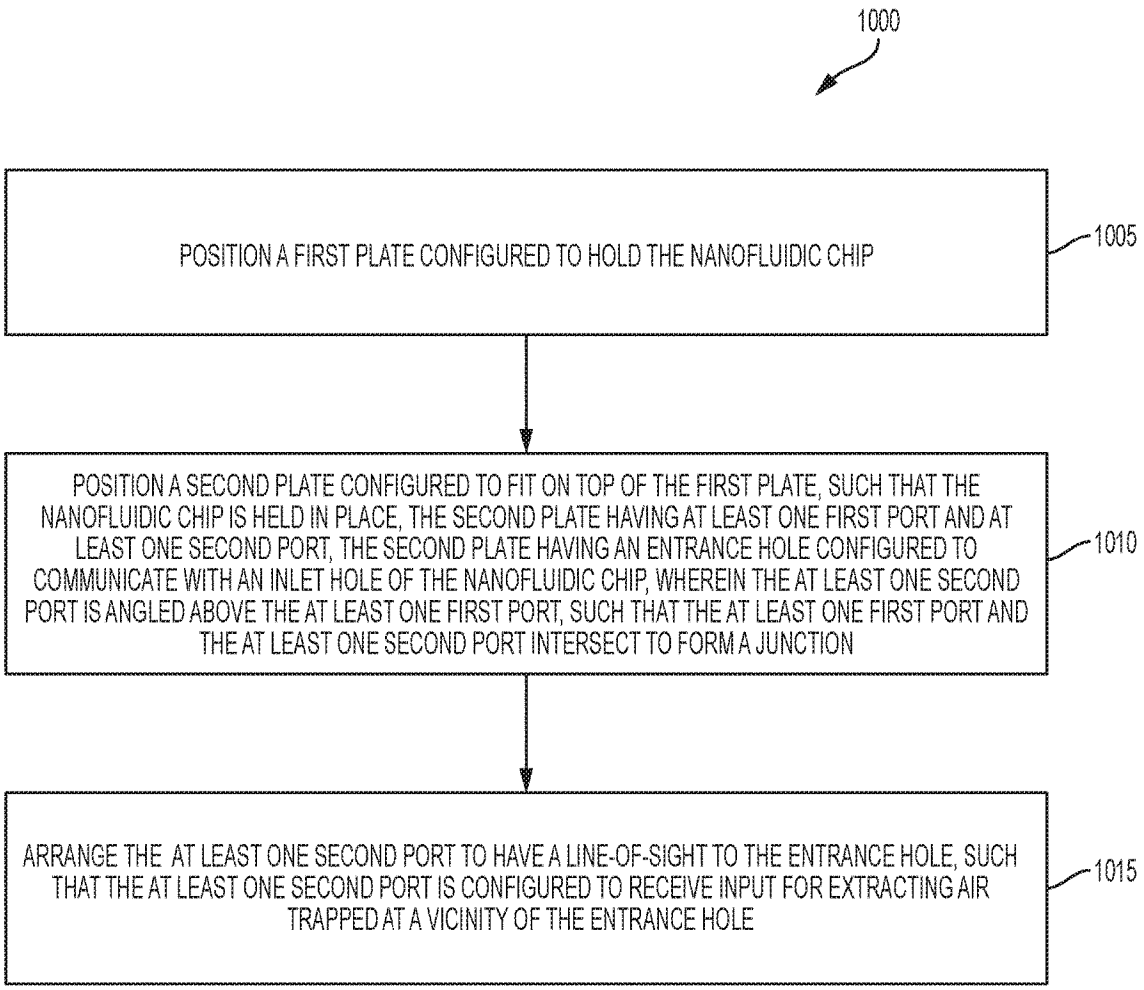
FIG. 10 is a flow chart of a method of configuring a fluidic cell to enable air removal according to an embodiment.

FIG. 10 is a flow chart 1000 of a method of configuring a fluidic cell 10, 700 to enable air removal according to an embodiment.

At block 1005, a first plate 12 (e.g., mounting base) is configured to hold the nanofluidic chip 18.

At block 1010, a second plate 14 (e.g., connector plate) is configured to fit on top of the first plate 12, such that the nanofluidic chip 18 is held in place, where the second plate has at least one first port 20A and at least one second port 502, where the second plate has an entrance hole 22A configured to communicate with an inlet hole 24A, 26A of the nanofluidic chip 18, where the at least one second port 502 is angled above the at least one first port 20A, such that the at least one first port and the at least one second port intersect to form a junction 550.

At block 1015, the at least one second port 502 is arranged to have a line-of-sight to the entrance hole 22, such that the at least one second port 502 is configured to receive input for extracting air trapped at a vicinity of the entrance hole 22A.

The entrance hole 22 of the second plate 14 is aligned to the inlet hole 24A, 26A of the nanofluidic chip 18. The at least one second port 502 is configured to accommodate input of a micro-connector 506 in order to extract the air 540 trapped at the vicinity of the entrance hole 22A.

The vicinity of the entrance hole 22A, from which the air bubble 540 is to be extracted, is at a chip interface 560 between the nanofluidic chip 18 and the second plate 14. The at least one second port 502 is configured with a reservoir 602. The reservoir 602 of the at least one second port 502 is configured to receive one or more air bubbles 540 in response to pressure forced into the junction 532, 550 via the at least one first port 20A.

The first plate and the second plate can comprise numerous materials including plastics, e.g. polyetheretherketone, acrylic, polytetrafluoroethylene, etc., metals, ceramics, or elastomers, e.g. crosslinked polysiloxanes. The choice of cell material depends on the application requirements, particularly the nature of the fluid to be used and the sample processed in the nanofluidic chip.

Figure 11:
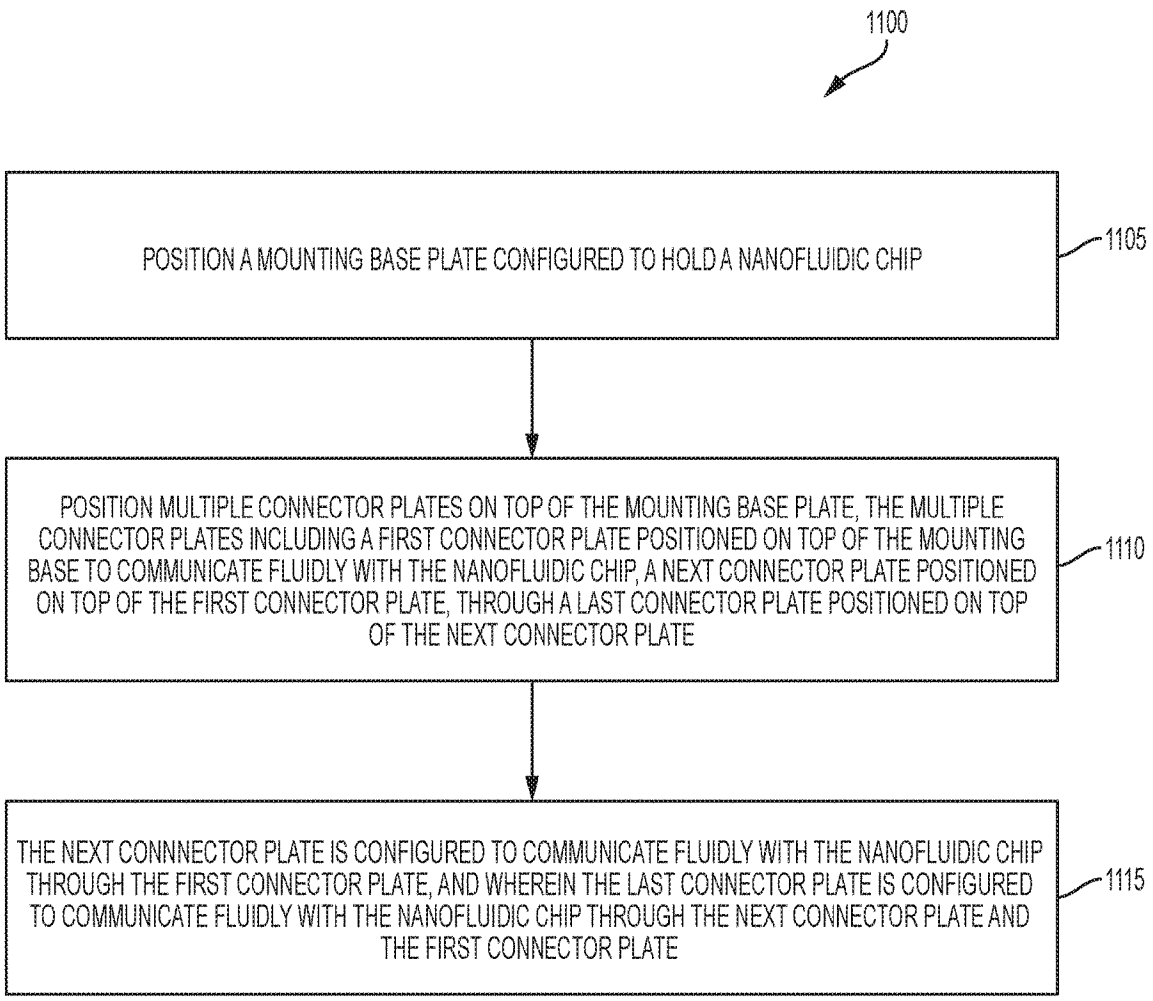
FIG. 11 is a flow chart of a method of configuring a fluidic cell with multiple stages according to an embodiment.

FIG. 11 is a flow chart 1100 of a method of configuring a fluidic cell 700 with multiple stages according to an embodiment.

At block 1105, a mounting base plate 12 is configured to hold a nanofluidic chip 18.

At block 1110, multiple connector plates 14 are positioned on top of the mounting base plate 12, where the multiple connector plates 14 include a first connector plate 701 positioned on top of the mounting base plate 12 to communicate fluidly with the nanofluidic chip 18, a next connector plate 702 positioned on top of the first connector plate 701, through a last connector plate 703 positioned on top of the next connector plate 702.

At block 1115, the next connector plate 702 is configured to communicate fluidly with the nanofluidic chip 18 through the first connector plate 701, and the last connector plate 703 is configured to communicate fluidly with the nanofluidic chip 18 through the next connector plate 702 and the first connector plate 701.

The last connector plate 703 comprises at least one external port 20A configured to receive input and at least one last connector hole 730 configured to feed the next connector plate 702.

The next connector plate 702 comprises at least one through via 732 configured to receive input from the at least one last connector hole 730 and at least one next connector hole 734 configured to feed the first connector plate 701.

The first connector plate 701 comprises at least one through via 738 configured to receive input from the at least one next connector hole 734 and at least one first connector hole 740 configured to feed the nanofluidic chip 18.

It will be noted that various microelectronic device fabrication methods may be utilized to fabricate the components/elements discussed herein as understood by one skilled in the art. In semiconductor device fabrication, the various processing steps fall into four general categories: deposition, removal, patterning, and modification of electrical properties.

Deposition is any process that grows, coats, or otherwise transfers a material onto the wafer. Available technologies include physical vapor deposition (PVD), chemical vapor deposition (CVD), electrochemical deposition (ECD), molecular beam epitaxy (MBE) and more recently, atomic layer deposition (ALD) among others.

Removal is any process that removes material from the wafer: examples include etch processes (either wet or dry), and chemical-mechanical planarization (CMP), etc.

Patterning is the shaping or altering of deposited materials, and is generally referred to as lithography. For example, in conventional lithography, the wafer is coated with a chemical called a photoresist; then, a machine called a stepper focuses, aligns, and moves a mask, exposing select portions of the wafer below to short wavelength light; the exposed regions are washed away by a developer solution. After etching or other processing, the remaining photoresist is removed. Patterning also includes electron-beam lithography.

Modification of electrical properties may include doping, such as doping transistor sources and drains, generally by diffusion and/or by ion implantation. These doping processes are followed by furnace annealing or by rapid thermal annealing (RTA). Annealing serves to activate the implanted dopants.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A method of configuring a fluidic cell with multiple stages, the method comprising:

positioning a mounting base plate configured to hold a nanofluidic chip;

positioning the nanofluidic chip in the mounting base plate; and positioning multiple connector plates on top of the mounting base plate, the multiple connector plates including a first connector plate positioned on top of the mounting base plate to communicate fluidly with the nanofluidic chip, a next connector plate positioned on top of the first connector plate, through a last connector plate positioned on top of the next connector plate;

wherein the next connector plate is configured to communicate fluidly with the nanofluidic chip through the first connector plate, the next connector plate being adjacent to the last connector plate, the next connector plate comprising at least one reservoir, the at least one reservoir having multiple next connector holes configured to feed the first connector plate; and wherein the last connector plate is configured to communicate fluidly with the nanofluidic chip through the next connector plate and the first connector plate.

2. The method of claim 1, wherein the last connector plate comprises at least one external port configured to receive input.

3. The method of claim 2, wherein the last connector plate comprises at least one last connector hole configured to feed the next connector plate.

4. The method of claim 3, wherein the next connector plate comprises at least one through via configured to receive input from the at least one last connector hole.

5. The method of claim 4, wherein the first connector plate comprises multiple through vias configured to receive input from the multiple next connector holes and at least one first connector hole configured to feed the nanofluidic chip;

wherein the at least one reservoir is positioned over the multiple through vias such that the multiple through vias are aligned with and match the multiple next connector holes.

6. The method of claim 4, wherein the at least one through via and the at least one last connector hole are about 2 mm in diameter.

7. The method of claim 4, wherein the at least one through via and the at least one last connector hole are about 2-3 mm in diameter.

8. The method of claim 1, wherein one or more of the multiple connector plates comprises plastic.

9. The method of claim 1, wherein one or more of the multiple connector plates comprises polyetheretherketone.

10. The method of claim 1, wherein one or more of the multiple connector plates comprises acrylic.

11. The method of claim 1, wherein one or more of the multiple connector plates comprises polytetrafluoroethylene.

12. The method of claim 1, wherein one or more of the multiple connector plates comprises metal.

13. The method of claim 1, wherein one or more of the multiple connector plates comprises ceramics.

14. The method of claim 1, wherein one or more of the multiple connector plates comprises elastomers.

15. The method of claim 1, wherein one or more of the multiple connector plates comprises polysiloxanes.

16. The method of claim 1, wherein the multiple connector plates are configured for stepping down fluid inputs for device interfacing.

17. The method of claim 16, wherein stepping down fluid inputs means transferring fluid from a larger channel into smaller channels.

18. The method of claim 17, wherein the smaller channels feed the nanofluidic chip.

19. The method of claim 1, wherein the mounting base plate comprises plastic.

* * * * *